US012800190B2

(12) United States Patent
Miller

(10) Patent No.: US 12,800,190 B2
(45) **Date of Patent: *Nov. 17, 2026**

(54) RECHARGABLE, PORTABLE HEATING DEVICE FOR WARMING USER

(71) Applicant: Good Works Funding, Inc., Chapel Hill, NC (US)

(72) Inventor: Judith Selene Miller, Chapel Hill, NC (US)

(73) Assignee: Good Works Funding, Inc., Chapel Hill, NC (US)

( * ) Notice: Subject to any disclaimer, the term of this patent is extended or adjusted under 35 U.S.C. 154(b) by 405 days.

This patent is subject to a terminal disclaimer.

(21) Appl. No.: 18/411,716

(22) Filed: Jan. 12, 2024

(65) Prior Publication Data

US 2024/0318867 A1 Sep. 26, 2024

Related U.S. Application Data

(63) Continuation of application No. 18/123,639, filed on Mar. 20, 2023, now Pat. No. 11,874,027.

(51) Int. Cl.
*F24H 3/04* (2022.01)

(52) U.S. Cl.
CPC ..... *F24H 3/0417* (2013.01)

(58) Field of Classification Search
CPC . F24H 3/002; F24H 3/02; F24H 3/022; F24H 3/04; F24H 3/0405; F24H 3/0417; F24H 9/0052; F24H 9/0073; F24H 9/1863; H05B 2203/022; H05B 3/008; A47C 21/04; A47C 21/048
See application file for complete search history.

(56) References Cited

U.S. PATENT DOCUMENTS

| | | | | |
|---|---|---|---|---|
| 5,578,230 | A * | 11/1996 | Eldon | A47G 9/0215 392/383 |
| 5,730,120 | A | 3/1998 | Yonkers, Jr. | |
| 6,711,767 | B2 | 3/2004 | Klamm | |
| 9,782,016 | B2 | 10/2017 | Aramli | |
| 9,949,570 | B1 | 4/2018 | Young | |
| 10,390,628 | B2 | 8/2019 | Pisani | |
| 10,524,581 | B2 | 1/2020 | Aramli | |
| 10,582,776 | B2 | 3/2020 | Aramli | |
| 10,588,419 | B2 | 3/2020 | Aramli | |
| 10,660,451 | B2 | 5/2020 | Aramli | |
| 2003/0188382 | A1 | 10/2003 | Klamm et al. | |
| 2006/0101577 | A1 | 5/2006 | Lussier | |
| 2010/0032131 | A1 | 2/2010 | Aharon | |
| 2010/0290765 | A1* | 11/2010 | Lee | F24H 9/02 126/90 A |

(Continued)

*Primary Examiner* — Justin C Dodson

(74) *Attorney, Agent, or Firm* — Neo IP

(57) ABSTRACT

A portable heating device for delivering warm air to the extremities of a user, for increasingly comfort and/or facilitating sleep. The portable heating device includes a heating module situated within a case, and a retractable and detachable hose that is able to attached to a hot air-releasing vent on the heating module to deliver the hot air to a desired space. The portable case includes an electronic display and a control unit for setting a desired temperature set point. The heating module is able to be powered by either a cable connected to an external power source and/or one or more internal batteries within the heating module.

20 Claims, 15 Drawing Sheets

(56) References Cited

U.S. PATENT DOCUMENTS

| | | | | |
|---|---|---|---|---|
| 2012/0180784 | A1* | 7/2012 | Vandrak | F24H 9/02 126/92 AC |
| 2014/0284022 | A1* | 9/2014 | Maxbauer | F24H 3/0417 165/41 |
| 2018/0289169 | A1 | 10/2018 | Le et al. | |
| 2019/0069689 | A1* | 3/2019 | Pisani | F24H 3/0423 |
| 2019/0261780 | A1 | 8/2019 | Aramli | |
| 2021/0196051 | A1 | 7/2021 | Aramli | |

* cited by examiner

RECHARGABLE, PORTABLE HEATING DEVICE FOR WARMING USER

CROSS REFERENCES TO RELATED APPLICATIONS

This application is related to and claims priority from the following U.S. patents and patent applications. This application is a continuation of U.S. patent application Ser. No. 18/123,639, filed Mar. 20, 2023, which is incorporated herein by reference in its entirety.

BACKGROUND OF THE INVENTION

1. Field of the Invention

The present invention relates to heating devices and systems for warming up an enclosed area, and more specifically relates to portable heating devices and systems for warming up the air under a blanket or within a sleeping bag.

2. Description of the Prior Art

It is generally known in the prior art to provide convection space heaters. Existing systems typically include a space heater designed to warm up a small room using convection heating.

Prior art patent documents include the following:

US Patent Publication No. 2021/0196051 for Bedding climate control apparatus and method to operate thereof with a programmable application from a wireless network by inventor Aramli, filed Apr. 27, 2020 and published Jul. 1, 2021, is directed to an apparatus and method to selectively create a heat transfer effect and sensation of cooling within bedding on a mattress. A programmable application is accessible on a wireless network and is programmed to provide appropriate settings to attain changes over time of a space within bedding that pertain to at least one of heating the space and realizing a cooling sensation within the space. A wireless receiver is configured to receive commands in a wireless manner that are indicative of the appropriate settings provided by the programmable application to effect changes over time of the space within the bedding attributed to heat transfer with respect to the at least one of heating the space and realizing a cooling sensation within the space. The heat transfer occurs as a result of fluid flow either within a mattress or within space in bedding over the mattress.

US Patent Publication No. 2019/0261780 for Bedding climate control apparatus and method to operate thereof that includes a blower or fan and thermal element that activates or deactivates at a preset clock time or other programmed event by inventor Aramli, filed Apr. 1, 2019 and published Aug. 29, 2019, is directed to a bedding climate control apparatus that delivers, in a quiet manner, forced airflow from a fan/blower within a housing to selectively deliver tempered (heated via a thermal element) forced airflow and non-tempered (room temperature) forced airflow through a flexible air conduit to bedding. The blower or fan is operated with no heat from the thermal element such that the blower or fan activates or deactivates at a preset clock time or other programmed event.

US Patent Publication No. 2018/0289169 for Multi-functional heater for warming bed covers by inventors Le, et al., filed Apr. 9, 2018 and published Oct. 11, 2018, is directed to a multifunctional heater that blows warmed/cooled air for a variety of usages primarily in the bedroom. The warm/cool air is blown through several accessories, including a body blanket warmer, stuffed animal warmers, foot panel warmers, knee wedge warmers as well as a universal warmer container for warming body pillows, knee wedges, towels and other items. The multifunctional heater is useful in distributing different heat levels to each person sleeping in the bed, providing optimal comfort for each person in the bed. The device also comes with an aromatherapy unit to distribute aromas through the night to facilitate sleeping.

US Patent Publication No. 2010/0290765 for Heater by inventor Lee, filed Jun. 23, 2009 and published Nov. 18, 2010, is a heater capable of supplying heated air to any desired place. The heater includes a heater housing having an air-inflow part and a first air-discharge port, a heating unit disposed in the heater housing to heat air, and a heated-air supply guide connected to the first air-discharge port and guiding heated air discharged through the first air-discharge port 121. The heated-air supply guide has a variable flow channel to change a heated-air supply zone. The heater can perform rapid local heating for a desired place, reduce energy consumption, and improve use convenience.

US Patent Publication No. 2010/0032131 for Portable climate control system by inventor Aharon, filed Oct. 9, 2007 and published Feb. 11, 2010, is directed to presented herein is a portable climate control system that enables user-adjustable air temperature manipulation and is suitable for indoor and outdoor use, comprising a portable housing; at least one fan disposed on said housing for moving an air supply through the housing; a core disposed within the housing, that contains material that enables altering at least one attribute of the air supply moving through the housing; a plurality of fins, radially disposed between the housing and the core, to support the core within the housing; and an air outlet hose, disposed on the housing, for delivering the manipulated air supply from the housing to a desired location.

US Patent Publication No. 2006/0101577 for Bed ventilator by inventor Lussier, filed Nov. 14, 2005 and published May 18, 2006, is directed to a bed ventilator for drawing surrounding air thereinto, treating the surrounded air drawn thereinto with a selected air treatment component so as to produce treated air and blowing the treated air under a bed covering of a bed, the bed including a mattress and a mattress support supporting the mattress. The bed ventilator includes: a casing including an inlet, an outlet and a passageway extending therebetween for fluidly coupling the inlet and the outlet, the casing being configured and sized so that the outlet is positionable under the bed covering; an air circulator located between the inlet and the outlet for drawing the surrounding air through the inlet and blowing the treated air outwardly from the outlet; and a treatment component support mechanically coupled to the casing for removably supporting the air treatment component within said casing.

US Patent Publication No. 2003/0188382 for Sleeping bag with integral heating duct by inventor Klamm, filed Apr. 3, 2002 and published Oct. 9, 2003, is directed to a sleeping bag has a shell constructed by a flexible panel that is folded in half to form first and second panel portions. Adjacent edges of the first and second panel portions having complementary components of a fastener thereon to close the sleeping bag except for an opening at a head end thereof. A duct, secured to the first panel portion, has an opening between the first and second panel portions, and another opening outside the head end at which to connect to hair dryer. Heated air from the hair dryer is distributed throughout the sleeping bag prior to or during use by a camper.

U.S. Pat. No. 9,949,570 for Bed warmer system by inventor Young, filed Dec. 19, 2016 and issued Apr. 24, 2018, is directed to a bed warming system for heating the envelop formed between the surface of a bed sheet covering a bed mattress and a cover laying over the bed sheet. The bed warming system comprises a warm air generator having a cool air inlet, a warm air outlet, and an elongated conduit having a first end connected to the cool air inlet for directing cool air to the warm air generator and a second end for receiving cooling air, the elongated conduit is of sufficient length such that when the warm air generator is placed under a cover the second end of the elongated conduit is exposed and not under the cover.

U.S. Pat. No. 9,782,016 for Bedding climate control apparatus with forced airflow for heating and ventilating by inventor Aramli, filed Nov. 6, 2014 and issued Oct. 10, 2017, is directed to a bedding climate control apparatus that delivers, in a quiet manner, forced airflow from a fan/blower within a housing to selectively deliver tempered (heated via a thermal element) and untempered (room temperature) air through a flexible hose to bedding. The quiet manner is attained with acoustic foam in the path of incoming airflow to the fan/blower and by oversizing each of the components that create a pressure drop including the capacity of the fan/blower over what is needed to deliver a required amount of airflow. Temperature may be set remotely via a wireless remote control and via a Bluetooth enabled device.

U.S. Pat. No. 6,711,767 for Apparatus for warming a bed by inventor Klamm, filed Jan. 24, 2003 and issued Mar. 30, 2004, is directed to a device to heat bed covers prior to a person entering the bed on winter nights. This apparatus mounts on a side of the mattress being supported by adjustable elements that extend between the mattress and a box spring. A fan in the apparatus forces room air through an electric heating coil and then through an outlet which directs the air flow between the bed covers.

U.S. Pat. No. 5,730,120 for Bed ventilator system by inventor Yonkers, filed Feb. 20, 1997 and issued Mar. 24, 1998, is directed to a bed ventilator includes an electric motor driven axial flow fan for moving air between a mattress and a bed cover thereon. The fan and associated duct work is mounted on a thin flat support tongue extended beneath the mattress and sandwiched between the mattress and its supporting bed structure such as a box spring. The associated duct work includes telescopic duct sections adjustable to accommodate mattresses of different thickness and locking screws are provided for securing a selected telescopic relation between the duct sections for a particular mattress involved.

U.S. Pat. No. 5,578,230 for Heater system having housing with chamber for creating a turbulent spinning air vortex by inventor Eldon, filed Jun. 9, 1994 and issued Nov. 26, 1996, is directed to a battery operated portable human body heater. The portable heater uses conventional 12 volt batteries to power a portable hot box which provides blowing air with three temperature settings. The portable heater is compact and can be conveniently transported in a carry bag such as a back pack. The heater can be attached to a blanket, a jacket or pants to warm the human body. The heater can be set at high temperature, low temperature or air only. At the high temperature setting continuous 130 DEG F. heat is provided for over an hour. At the low temperature setting continuous 87-100 DEG F. heat is provided for over two hours. Blowing air without heat is provided for over 30 hours. The portable heater can also be powered or its batteries recharged by a typical wall socket or cigarette lighter in a car or boat.

U.S. Pat. No. 10,660,451 for Bedding climate control apparatus and method to operate thereof that compensates for backpressure and ambient temperature by inventor Aramli, filed Apr. 1, 2019 and issued May 26, 2020, is directed to a bedding climate control apparatus that delivers, in a quiet manner, forced airflow from a fan/blower within a housing to selectively deliver tempered (heated via a thermal element) forced airflow and non-tempered (room temperature) forced airflow through a flexible air conduit to bedding. The thermal element imparts heat to temper the forced airflow and the heat deliver may be adjusted to maintain a constant set temperature by adjusting imparted heating power depending on backpressure changes in the forced airflow and ambient temperature.

U.S. Pat. No. 10,588,419 for Bedding climate control apparatus and method to operate thereof that incudes a retention unit to retain in position both a flexible air conduit and bedding by inventor Aramli, filed Apr. 1, 2019 and issued Mar. 17, 2020, is directed to a bedding climate control apparatus that delivers, in a quiet manner, forced airflow from a fan/blower within a housing to selectively deliver tempered (heated via a thermal element) forced airflow and non-tempered (room temperature) forced airflow through a flexible air conduit to bedding. A retention unit holds the flexible air conduit in position against movement and simultaneously retains the bedding in place.

U.S. Pat. No. 10,582,776 for Bedding climate control apparatus and method to operate thereof to tent up bedding in a quiet manner because of noise dampening and component oversizing by inventor Aramli, filed Apr. 1, 2019 and issued Mar. 10, 2020, is directed to a bedding climate control apparatus that delivers, in a quiet manner, forced airflow from a fan/blower within a housing to selectively deliver tempered (heated via a thermal element) forced airflow and non-tempered (room temperature) forced airflow through a flexible air conduit to bedding. The quiet manner is attained with acoustic dampening material in the path of incoming airflow to the fan/blower and by oversizing each of the components that create a pressure drop including the capacity of the fan/blower over what is needed to deliver a required amount of airflow. Temperature may be set remotely via a wireless remote control and via a protocol access enabled device.

U.S. Pat. No. 10,524,581 for Bedding climate control apparatus and method to operate thereof by inventor Aramli, filed Aug. 21, 2017 and issued Jan. 7, 2020, is directed to a bedding climate control apparatus that delivers, in a quiet manner, forced airflow from a fan/blower within a housing to selectively deliver tempered (heated via a thermal element) and untempered (room temperature) air through a flexible hose to bedding. The quiet manner is attained with acoustic dampening material in the path of incoming airflow to the fan/blower and by oversizing each of the components that create a pressure drop including the capacity of the fan/blower over what is needed to deliver a required amount of airflow. Temperature may be set remotely via a wireless remote control and via a protocol access enabled device.

U.S. Pat. No. 10,390,628 for Instant hand-held bed sheet warmer by inventor Pisani, filed Aug. 31, 2018 and issued Aug. 27, 2019, is directed to a hand-held bed sheet warmer device for heating bedding, including an air intake configured to intake air, a fan and heating coil assembly to receive and heat the air to provide warm air, a handle configured in between the air intake and the fan and heating coil assembly and having a hollow cavity formed therein to allow the air to pass through the handle from the air intake to the fan and heating coil assembly, and a warm air distributor rod configured to receive the warm air and comprising a plurality of outlet vents configured to distribute the warm air to the bedding. The air intake, the fan and heating coil assembly, the handle and the warm air distributor are arranged linearly and the device is configured as a hand-held baton or shaft.

SUMMARY OF THE INVENTION

The present invention relates to heating devices and systems for warming up an enclosed area, and more specifically relates to rechargeable, portable heating devices and systems for warming up the air under a blanket or within a sleeping bag.

It is an object of this invention to provide a portable device capable of providing heat to an enclosed area under a blanket or within a sleeping bag without causing the blanked or sleeping bag to burn, and without causing harm to a user that is sleeping under the blanket or with in the sleeping bag.

In one embodiment, the present invention is directed to a portable heating device, including an exterior case, a heating module nested within the exterior case, and at least one battery unit connected to and powering the heating module, wherein the heating module includes at least one air intake, configured to take in air from the surrounding environment, wherein the heating module includes at least one air exhaust vent configured to attach to at least one retractable hose, and wherein the heating module includes at least one heating element configured to heat air entering through the at least one air intake and exiting through the at least one air exhaust vent.

In another embodiment, the present invention is directed to a portable heating device, including a heating module connected to and powered by at least one battery unit, at least one battery unit connected to and powering the heating module, wherein the heating module includes at least one air intake, configured to take in air from the surrounding environment, wherein the heating module includes at least one air exhaust vent configured to attach to at least one retractable hose, wherein the heating module includes at least one heating element configured to heat air entering through the at least one air intake and exiting through the at least one air exhaust vent, wherein the heating module is configured to receive signals from at least one remote device, and wherein the heating module is operable to adjust a temperature of outgoing air through the at least one air exhaust vent based on the signals from the at least one remote device, wherein the heating module receives sensor data from at least one temperature sensor attached to the at least one retractable hose, and wherein the heating module is configured to automatically adjust the temperature of the outgoing air based on the sensor data.

In yet another embodiment, the present invention is directed to a portable heating device, including an exterior case, a heating module nested within the exterior case, and at least one battery unit connected to and powering the heating module, wherein the heating module includes at least one air exhaust vent configured to attach to at least one retractable hose, wherein the heating module includes at least one heating element configured to heat air exiting through the at least one air exhaust vent, and wherein the heating module is operable to generate heated air through the at least one air exhaust vent while the exterior case is in a closed position.

These and other aspects of the present invention will become apparent to those skilled in the art after a reading of the following description of the preferred embodiment when considered with the drawings, as they support the claimed invention.

DETAILED DESCRIPTION

Figure 1:
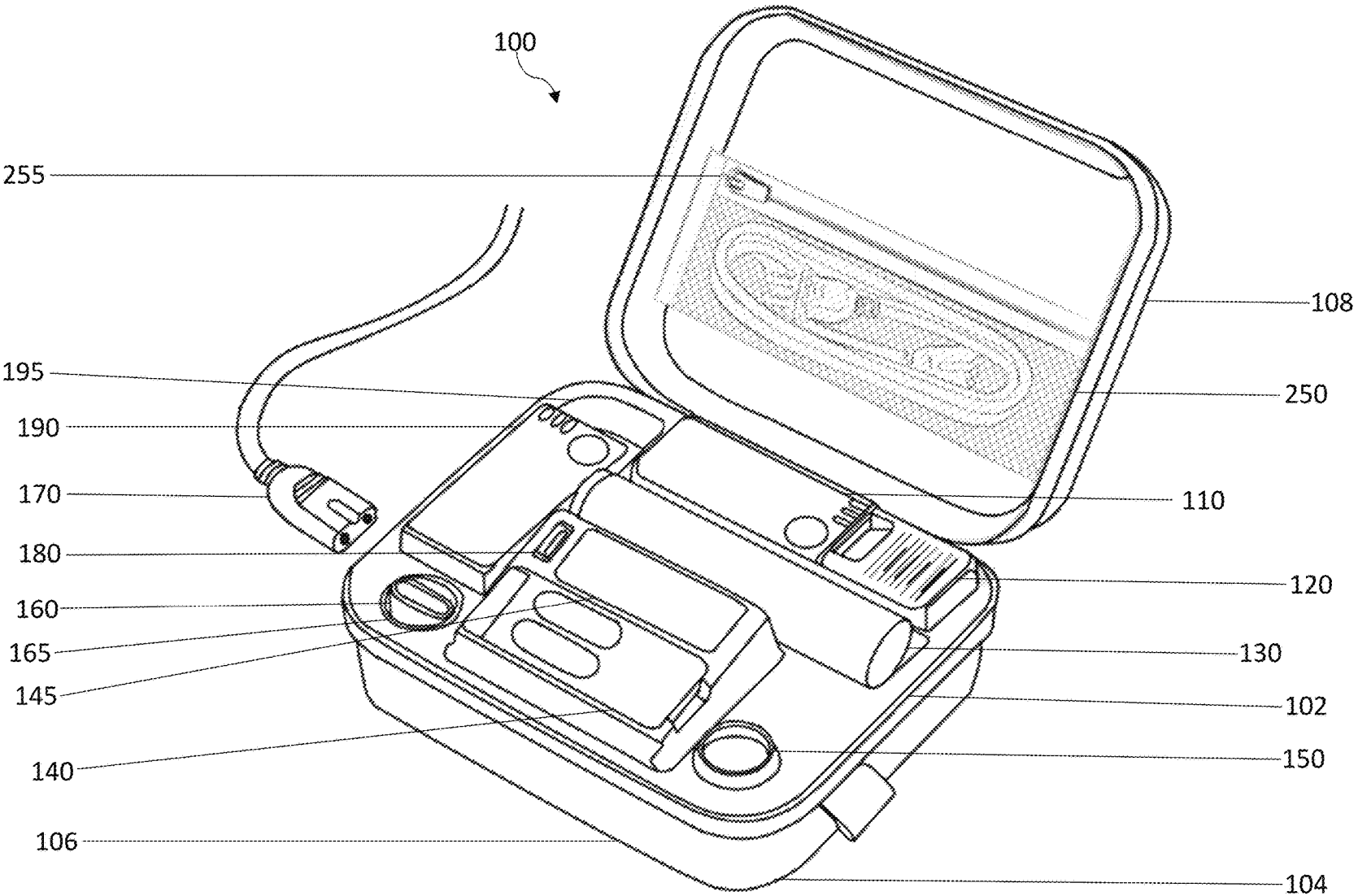
FIG. 1 illustrates a perspective view of a portable bed heating device including a travel case according to one embodiment of the present invention.

The present invention is generally directed to portable convection heating devices, and more specifically to portable convection heating devices for warming up the area under a blanket or within a sleeping bag.

In one embodiment, the present invention is directed to a portable heating device, including an exterior case, a heating module nested within the exterior case, and at least one battery unit connected to and powering the heating module, wherein the heating module includes at least one air intake, configured to take in air from the surrounding environment, wherein the heating module includes at least one air exhaust vent configured to attach to at least one retractable hose, and wherein the heating module includes at least one heating element configured to heat air entering through the at least one air intake and exiting through the at least one air exhaust vent.

In another embodiment, the present invention is directed to a portable heating device, including a heating module connected to and powered by at least one battery unit, at least one battery unit connected to and powering the heating module, wherein the heating module includes at least one air intake, configured to take in air from the surrounding environment, wherein the heating module includes at least one air exhaust vent configured to attach to at least one retractable hose, wherein the heating module includes at least one heating element configured to heat air entering through the at least one air intake and exiting through the at least one air exhaust vent, wherein the heating module is configured to receive signals from at least one remote device, and wherein the heating module is operable to adjust a temperature of outgoing air through the at least one air exhaust vent based on the signals from the at least one remote device, wherein the heating module receives sensor data from at least one temperature sensor attached to the at least one retractable hose, and wherein the heating module is configured to automatically adjust the temperature of the outgoing air based on the sensor data.

In yet another embodiment, the present invention is directed to a portable heating device, including an exterior case, a heating module nested within the exterior case, and at least one battery unit connected to and powering the heating module, wherein the heating module includes at least one air exhaust vent configured to attach to at least one retractable hose, wherein the heating module includes at least one heating element configured to heat air exiting through the at least one air exhaust vent, and wherein the heating module is operable to generate heated air through the at least one air exhaust vent while the exterior case is in a closed position.

In cold environments, it is common for people to feel discomfort, especially in their extremities, due to a lack of blood circulation when the body is exposed to cold environment. When exposed to cold environments, the human body naturally constrict the blood vessels that keep our extremities warm and redirects the blood flow to the core to keep our vital organs warm. Typically, when a person is sleeping in a cold environment, they will wear thicker layers and sleep with a heavier blanket to stay warm. Although this does an adequate job of protecting the person's core temperature, it does not prevent the persons extremities from experiencing discomfort. In moderately cold environments, the discomfort experienced in the extremities during cold temperatures, at a minimum, makes it difficult for people to fall asleep. In more harsh cold environments, the extremities and digits of the human body are more susceptible to frostbite.

This is especially a point of concern for avid campers who frequently camp in a tent with a sleeping bag and are more subject to the environment around them. There is a wide market for camping gear that is designed to protect people from the harsh conditions around them, but this market mostly consists of specials materials and fabrications that help insulate the user. Portable camping heaters do exist in the market, but they may cause carbon monoxide poisoning if they are used in an enclosed area. Typically there is no electric power source to provide power to electric heater, most portable camp heaters burn a combustible fuel to create heat which may cause carbon monoxide poisoning.

Most convection electric space heaters on the market draw 1,500 watts making it nearly impossible for batteries to generate enough electricity to sustain an electric heater for several hours. Another drawback is most electric space heaters do not include safety features to prevent unintentional combustion which poses a threat to the user. Most 1,500-watt electrical space heaters when put in contact with a typical bed blanket are more than capable of burning the entire blanket. Space heaters lead to 1,700 fires and 80 deaths a year due to their inherent flaws. This makes traditional electric space heaters unsuitable for heating up the area under a blanket or within a sleeping bag.

The prior art does not disclose a heating device with a retractable hose that is capable of being broken down and carried easily to new locations. For example, the system described in US Patent Publication No. 2021/0196051 does not provide any portability of the device for ease of transport. Additionally, systems such as that described in US Patent Publication No. 2021/0196051 require connection to power outlets and are not traditionally capable of being battery operated, resulting in particularly low utility in camping applications or other "off-grid" environments. Alternatively, units such as that described in U.S. Patent Pub. No. 2018/0289169 do not include any mechanism (i.e., a retractable hose) for delivering air to a space other than placing the entire, often cumbersome unit within the space, increasing danger and being particularly unsuited for tighter environments, such as sleeping bags.

Referring now to the drawings in general, the illustrations are for the purpose of describing one or more preferred embodiments of the invention and are not intended to limit the invention thereto.

FIG. 1 illustrates a perspective view of a portable heating device 100 including a heating module 102 nested within a travel case shell 104 according to one embodiment of the present invention. The portable heating device 100 includes at least one primary battery pack 110, at least one backup battery 190 configured to rest in a backup battery compartment 195, an extendable air hose 130, an air intake 120, a hot air exhaust vent 150, a remote control 140, an electronic display 145, an air nozzle 160 configured to rest within an air nozzle compartment 165, a universal serial bus (USB) port 180 (and/or any other type of connection port, e.g., AUX, USB-C, etc.), a power cord 170, a power cord pocket 250, and a power cord pocket zipper 255. The portable heating module 102 is designed to fit within the travel case shell 104 such that the travel case shell 104 encloses and protects the heating module 102 from being damaged during travel. The travel case shell 104 also serves the purpose of storing the power cord 170 during transportation. In one embodiment, the travel case includes a power cord pocket 250 that is designed to store one or more power cords (or other objects) in a safe compartment that is selectively openable via the power cord pocket zipper 255. The travel case shell 104 includes a lid 108 configured to matingly close with a lower component 106 of the travel case shell 104, allowing the case 104 to close and fully encapsulate the heating module 102.

In one embodiment, the backup battery compartment 195 includes a depression in a top surface of the heating module 102 sized and shaped to fit at least one backup battery 190, such that the at least one backup battery 190 is able to be easily rested on the backup battery compartment 195 for storage and later use. In another embodiment, the backup battery compartment includes at least one chamber within the heating module 102 including, for example, a lid for fully encapsulating the at least one backup battery 190 for storage and later use. Similarly, in one embodiment, the air nozzle compartment 165 includes a depression in a top surface of the heating module 102 sized and shaped to fit at least one air nozzle 160, such that the at least one air nozzle 160 is able to be easily rested in or on the air nozzle compartment 165 for storage and later use. In another embodiment, the air nozzle compartment 165 includes at least one chamber within the heating module 102, including, for example, a lid for fully encapsulating the at least one air nozzle 160 for storage and later use.

One of ordinary skill in the art will understand that several features shown in FIG. 1 are optional for the portable heating device 100, including the backup battery compartment 195 and the backup battery 190, as well as the air nozzle compartment 165 and the air nozzle 160. In one embodiment, air nozzles 160 and backup batteries 190 are stored separately, outside of the travel case shell 104. Furthermore, one of ordinary skill in the art will understand that the specific orientation of components within the travel case shell 104 are not intended to be limiting to those orientations shown in FIG. 1 or the other figures. By way of example and not limitation, FIG. 1 shows the electronic display 145 as being at the front of the heating module 102, in front of the extendable air hose 130, but, in another embodiment, the extendable air hose 130 is in front of the electronic display 145.

Figure 2:
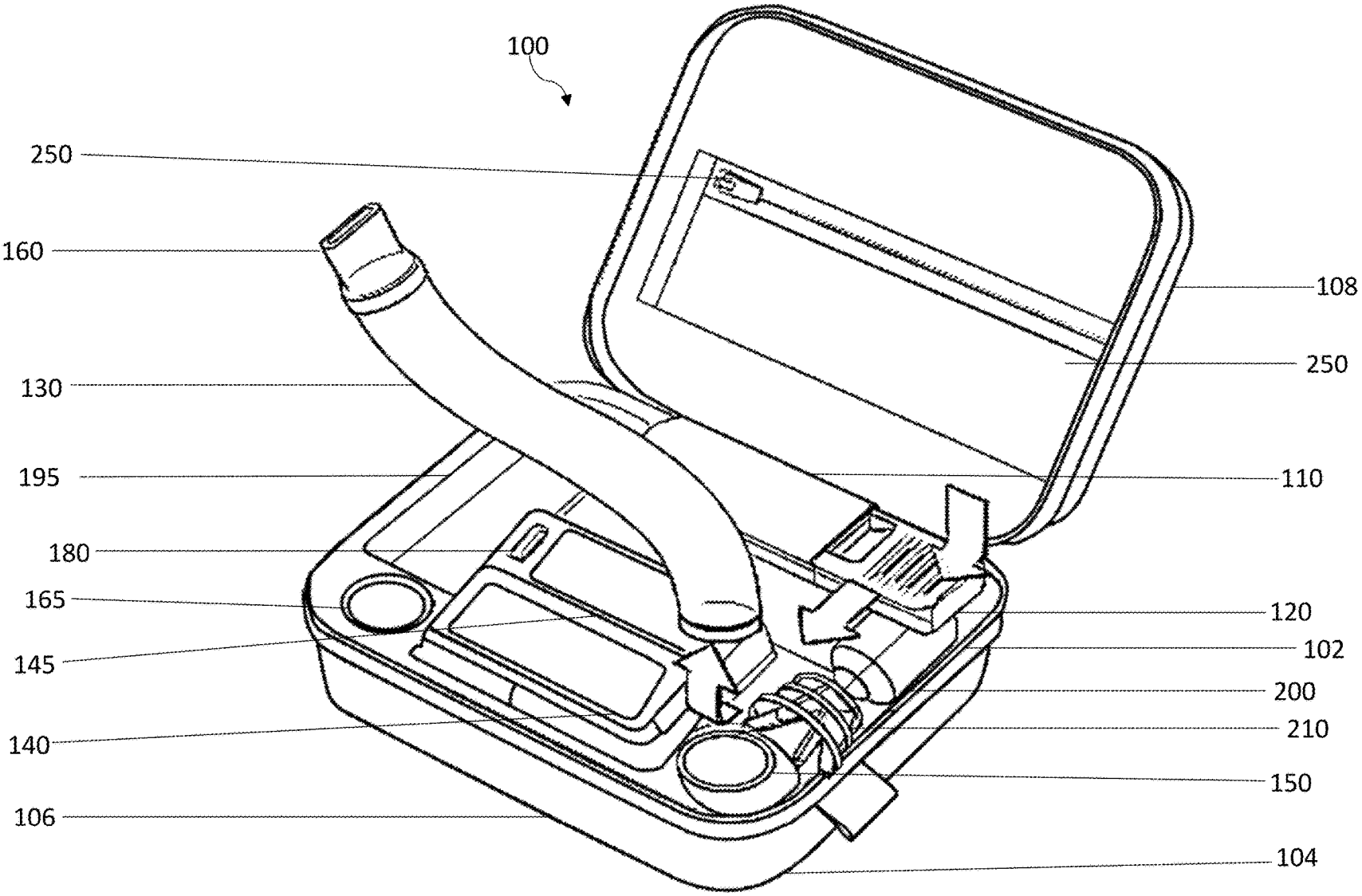
FIG. 2 illustrates a partially transparent perspective view of a portable bed heating device with a travel case and an air hose in an extended position according to one embodiment of the present invention.

FIG. 2 illustrates a partially transparent perspective view of a portable heating device 100 including a heating module 102 within a travel case 104 and an extendable air hose 130 in an extended position according to one embodiment of the present invention. The portable heating device 100 includes at least one primary battery pack 110, a backup battery compartment 195, an extendable air hose 130, an air intake 120, a motor 200, a heating element 210, a hot air exhaust vent 150, a remote control 140, an electronic display 145, an air nozzle 160, an air nozzle compartment 165, a universal serial bus USB port 180, a power cord 170, a power cord pocket 250, and a power cord pocket zipper 255

The air intake 120 of the portable heating device 100 has a built in fan that is connected to the motor 200 via a shaft. The air intake 120 pulls in air from the surrounding environment and force it into the portable heating device 100 using the internal fan. Once the fan within the air intake 120 has pulled in the cold air from the environment, the cold air is forced towards the heating element 210. In one embodiment, the heating element 210 includes at least one heating coil (and/or at least one ribbon or strip of wire), which resistively heats as current is run through the coil via from the at least one primary battery pack 110 or by at least one external power source (e.g., a power outlet). In one embodiment, the heating element 210 is formed from at least one ceramic material, coated with at least one ceramic material, at least one gemstone (e.g., Tourmaline), at least one metal (e.g., Nichrome, titanium, etc.), and/or a combination of one or more materials. The natural resistance of the heating coil of the heating element 210 transforms the energy from the current into dissipated heat. The heat of the heating element 210 heats up the air that was pulled in by the air intake 120. After the air is heated up by the heating element 210, the heated air is forced out through the hot air exhaust vent 150, which is an opening extending from the top surface of the heating module 102. In one embodiment, the hot air exhaust vent 150 is attached to the extendable air hose 130. The extendable air hose 130 directs the air away from the portable heating device 100 as necessary, which is advantageous for directing the warm air through the hose and air nozzle, past a safety sensor to underneath a blanket or into the bottom of a sleeping bag. The air nozzle 160 is designed to increase the exhaust air flow rate and provide further accuracy in directing the air towards a desired location. In one embodiment, the interior and/or exterior surfaces of the extendable air hose 130 and/or the air nozzle 160 are formed from nonflammable materials and/or coated with a heat resistant coating.

In one embodiment, the extendable air hose 130 connects to the hot air exhaust vent 150 via threaded connection. For example, in one embodiment, the extendable air hose 130 has a diameter greater than the hot air exhaust vent 150 and at least one end of the extendable air hose 130 includes internal threading configured to matingly connect with external threading surrounding the hot air exhaust vent 150. In another embodiment, the extendable air hose 130 has a diameter smaller than the hot air exhaust vent 150 and at least one end of the extendable air hose 130 includes external threading configured to matingly connect with internal threading of the hot air exhaust vent 150. In another embodiment, the extendable air hose 130 is connected to the hot air exhaust vent 150 via frictional engagement (e.g., engagement between interior surface of the extendable air hose 130 and an exterior surface of the hot air exhaust vent 150, engagement between the exterior surface of the extendable air hose 130 and an interior surface of the hot air exhaust vent 150, etc.). In one embodiment, the extendable air hose 130 is connected to the hot air exhaust vent 150 via click connection. Attachment methods such as frictional engagement and threading allows the extendable air hose 130 to easily be connected and disconnected with the hot air exhaust vent 150, allowing for easier portability and convenience. One of ordinary skill in the art will understand that the connection methods between the extendable air hose 130 and the hot air exhaust vent 150 are not intended to be limiting according to the present invention.

In one embodiment, the extendable air hose 130 is a collapsible plastic hose (similar to a vacuum hose). In another embodiment, the extendable air hose 130 includes an interior plastic coating and an exterior fabric cover, for improving appearances and textures, providing a heat resistant covering, and providing increased resistance to tearing.

In one embodiment, the extendable air hose 130 connects to the air nozzle 160 via threaded connection. For example, in one embodiment, the extendable air hose has a diameter greater than the air nozzle 160 and at least one end of the extendable air hose 130 includes internal threading configured to matingly connect with external threading surrounding the air nozzle 160. In another embodiment, the extendable air hose 130 has a diameter smaller than the air nozzle 160 and at least one end of the extendable air hose 130 includes external threading configured to matingly connect with internal threading of air nozzle 160. In another embodiment, the extendable air hose 130 is connected to the air nozzle 160 via frictional engagement (e.g., engagement between interior surface of the extendable air hose 130 and an exterior surface of the air nozzle 160, engagement between the exterior surface of the extendable air hose 130 and an interior surface of the air nozzle 160, etc.). In one embodiment, the extendable air hose 130 is connected to the air nozzle 160 via click connection.

In one embodiment, when the extendable air hose 130 is detached from the heating module 102, the power supply is automatically cut off. This provides a quick shut-off system, preventing the system from continuing to heat without the hose connected, which otherwise has the potential to waste energy or heat unintended areas. Furthermore, because the vent, without the hose attached, has a greater potential for becoming occluded, the automatic shut-off prevents the system from overheating and potentially causing a fire.

In one embodiment, the extendable air hose 130 is substantially symmetric, such that either end of the extendable air hose 130 is capable of connecting to the hot air exhaust vent 150. In another embodiment, only a single end of the extendable air hose 130 is able to connect to the hot air exhaust vent 150. Similarly, in one embodiment, either end of the extendable air hose 130 is capable of connecting to the air nozzle 160, while, in another embodiment, only one end of the extendable air hose 130 is able to connect to the air nozzle 160.

Figure 3:
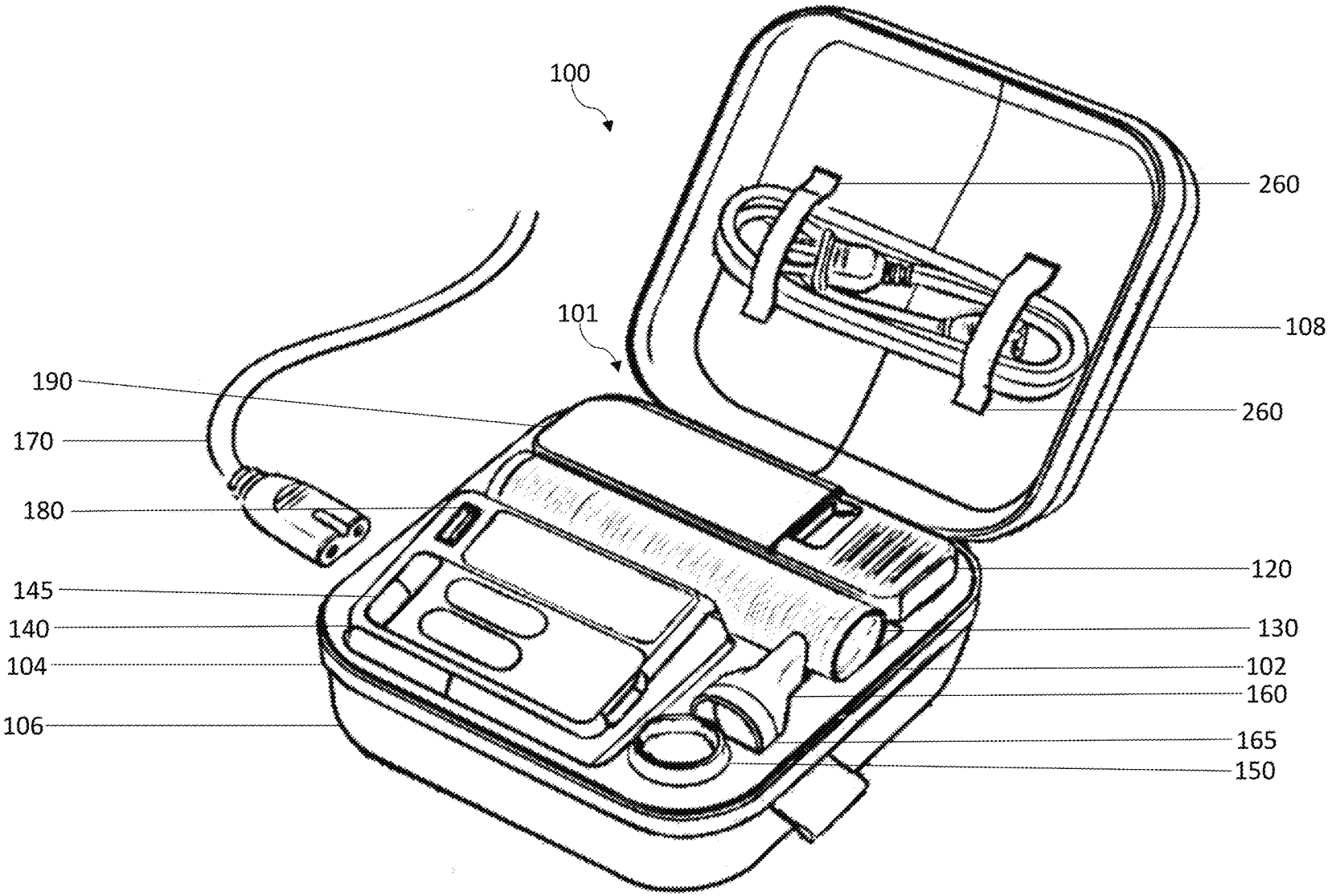
FIG. 3 illustrates an exploded perspective view of a portable bed heating device according to one embodiment of the present invention.
Figure 4:
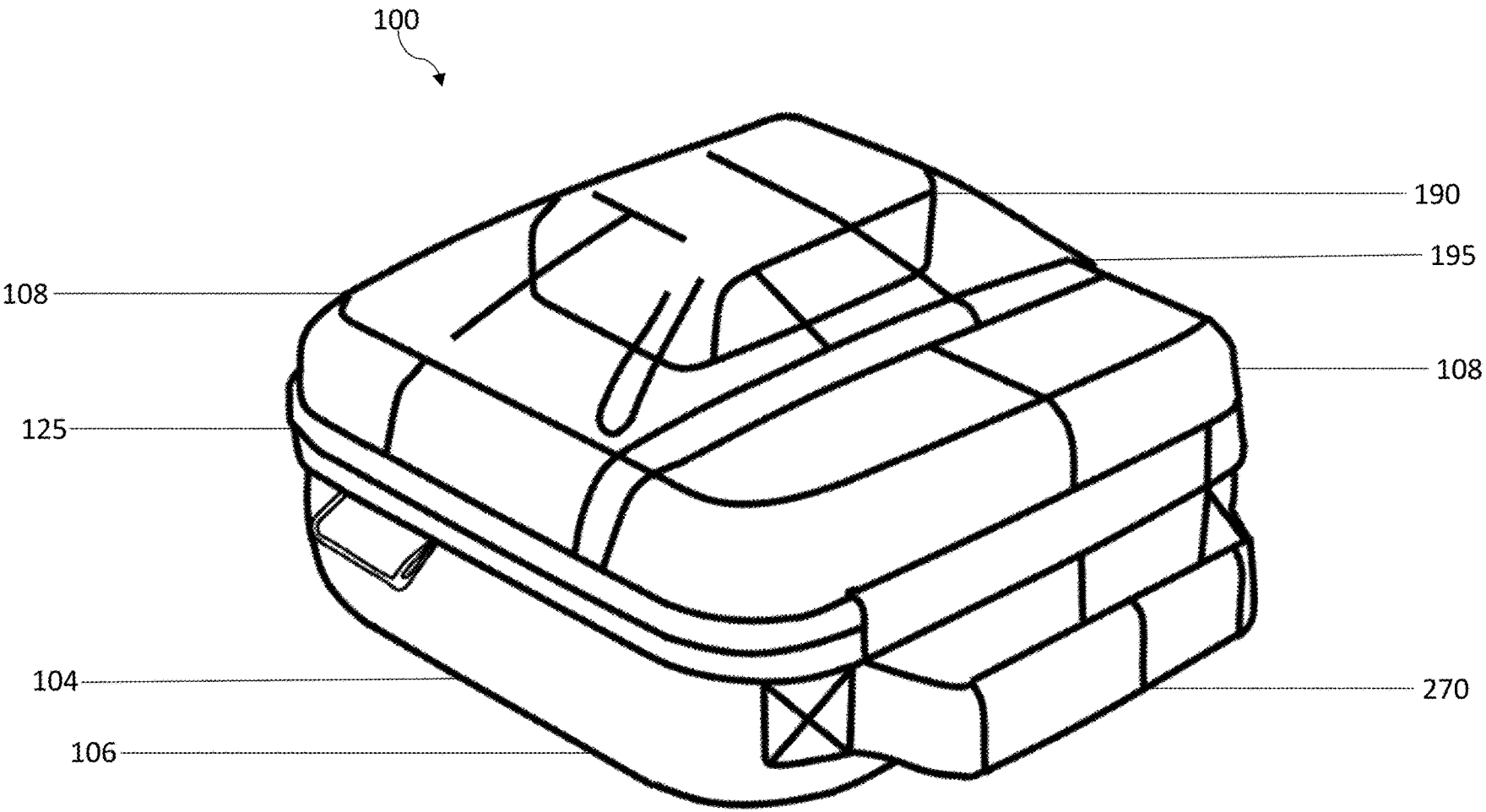
FIG. 4 illustrates a perspective view of a closed travel case according to one embodiment of the present invention.

FIGS. 3 and 4 illustrate a perspective view of a portable heating device 100 including a heating module 102 inside of a travel case shell 104 according to one embodiment of the present invention. The portable heating device 100 includes at least one primary battery pack 110, at least one backup battery 190, a backup battery compartment 195, an extendable air hose 130, an air intake 120, a hot air exhaust vent 150, a remote control 140, an electronic display 145, an air nozzle 160, an air nozzle compartment 165, a universal serial bus USB port 180, a power cord 170, a handle 270, a travel case zipper 125, and at least two power cord straps 260. The portable heating device 100 is designed to fit in the travel case shell 104 such that the travel case shell 104 protects the heating module 102 from being damaged during travel. The travel case shell 104 also serves the purpose of storing the power cord 170 during travel.

In one embodiment, the travel case shell 104 has a clam shell shape such it includes a lower component 106 connected to an upper component 108 via a hinge 101. The travel case zipper 125 is operable to fasten the lower component 106 to the upper component 108 in a closed position. This is advantageous for transportation and storing the portable heating device 100. The travel case shell 104 includes the at least two power cord straps 260 such that the at least two power cord straps 260 are fastened to the interior surface of the upper component 108. The at least two power cord straps 260 are operable to securely store the power cord 270 within the travel case shell 104. In one embodiment, each of the at least two power cord straps 260 have two attachment points that secure the power cord to the interior surface of the upper component 108. One of the two attachment points use hook and loop tape to attach and detach from the interior surface of the upper component 108 as necessary enabling for quick securing and deploying of the power cord 170. In another embodiment, the at least two power cord straps 260 are magnetically attached to the interior surface of the upper component 108. In yet another embodiment, the at least two power cord straps 260 are adhesively attached to the interior surface of the upper component 108.

The travel case shell 104 also serves the purpose of storing the at least one backup battery 190. The travel case shell 104 has a backup battery compartment 195 that is located on the exterior surface of the upper component 108. The backup battery compartment 195 stores the backup battery 190. In one embodiment the backup battery compartment 195 is closed using a zipper to prevent the backup battery 190 from unintentionally falling out of the travel case shell 104. In another embodiment, the backup battery compartment 195 is closed using hook and loop tape to prevent the backup battery 190 from unintentionally falling out of the travel case shell 104.

Figure 5:
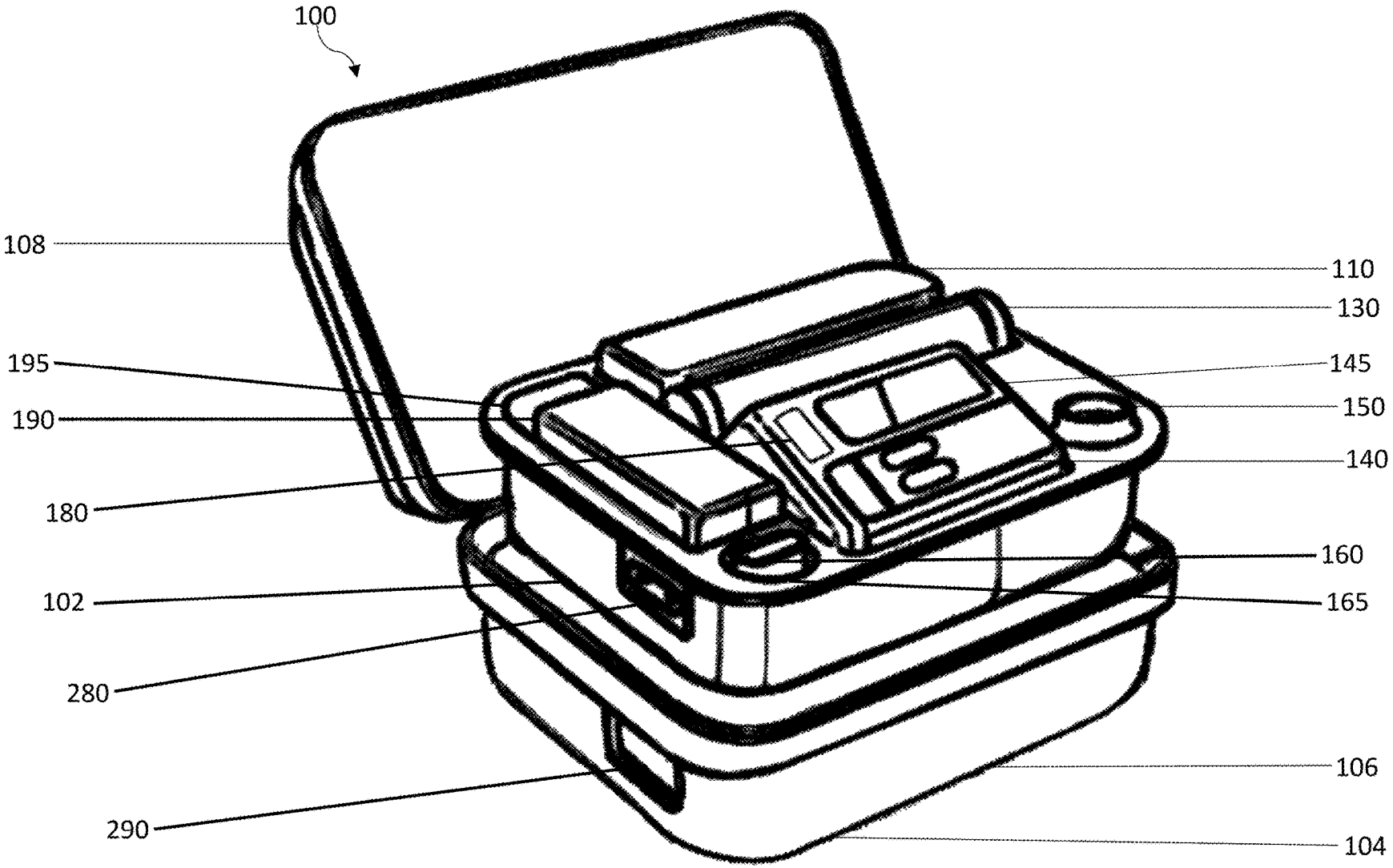
FIG. 5 illustrates an exploded view of a portable bed heating device in a travel case according to one embodiment of the present invention.

FIG. 5 illustrates an exploded perspective view of a portable bed heating device 100 including a heating module 102 detached from a travel case shell 104 according to one embodiment of the present invention. The portable heating device 100 includes at least one primary battery pack 110, at least one backup battery 190, a backup battery compartment 195, an extendable air hose 130, an air intake 120, a hot air exhaust vent 150, a remote control 140, an electronic display 145, an air nozzle 160, an air nozzle compartment 165, a universal serial bus USB port 180, a charging port 280, and a charging port opening 290.

The travel case shell 104 has a clam shell shape such it includes a lower component 106 connected to an upper component 108 via a hinge. The travel case zipper 125 is operable to fasten the lower component 106 to the upper component 108 in a closed position. This is advantageous for transportation and storing the portable heating device 100. The lower component 106 is designed to fit and encapsulate the heating module 102 in a nested position within the travel case shell 104. The upper component 108 is designed to close onto the lower component while the heating module 102 is nested within the lower component 106. The upper component protects the top of the heating module 102 from coming into contact with hard surfaces.

The charging port 280 and the charging port opening 290 are positioned within the heating module 102 and lower component 106 respectively such that, when the heating module 102 is nested within the travel case shell 104 the charging port 280 is in the same plane as the charging port opening 290. The positioning of the charging port 280 and the charging port opening 290 is critical for ensuring that a cord is operable to connect to the charging port 280 and deliver power to the heating module 102 while the heating module 102 is within the case. In one embodiment, the charging port opening 290 is operable to be closed with a hinged cover to shield the charging port 280 from the outside elements. In one embodiment, the charging port 280 and the charging port opening 290 are each on the left side of the heating module 102 and lower component 104. In another embodiment, the charging port 280 and the charging port opening 290 are each on the right side of the heating module 102 and lower component 104.

Figure 6:
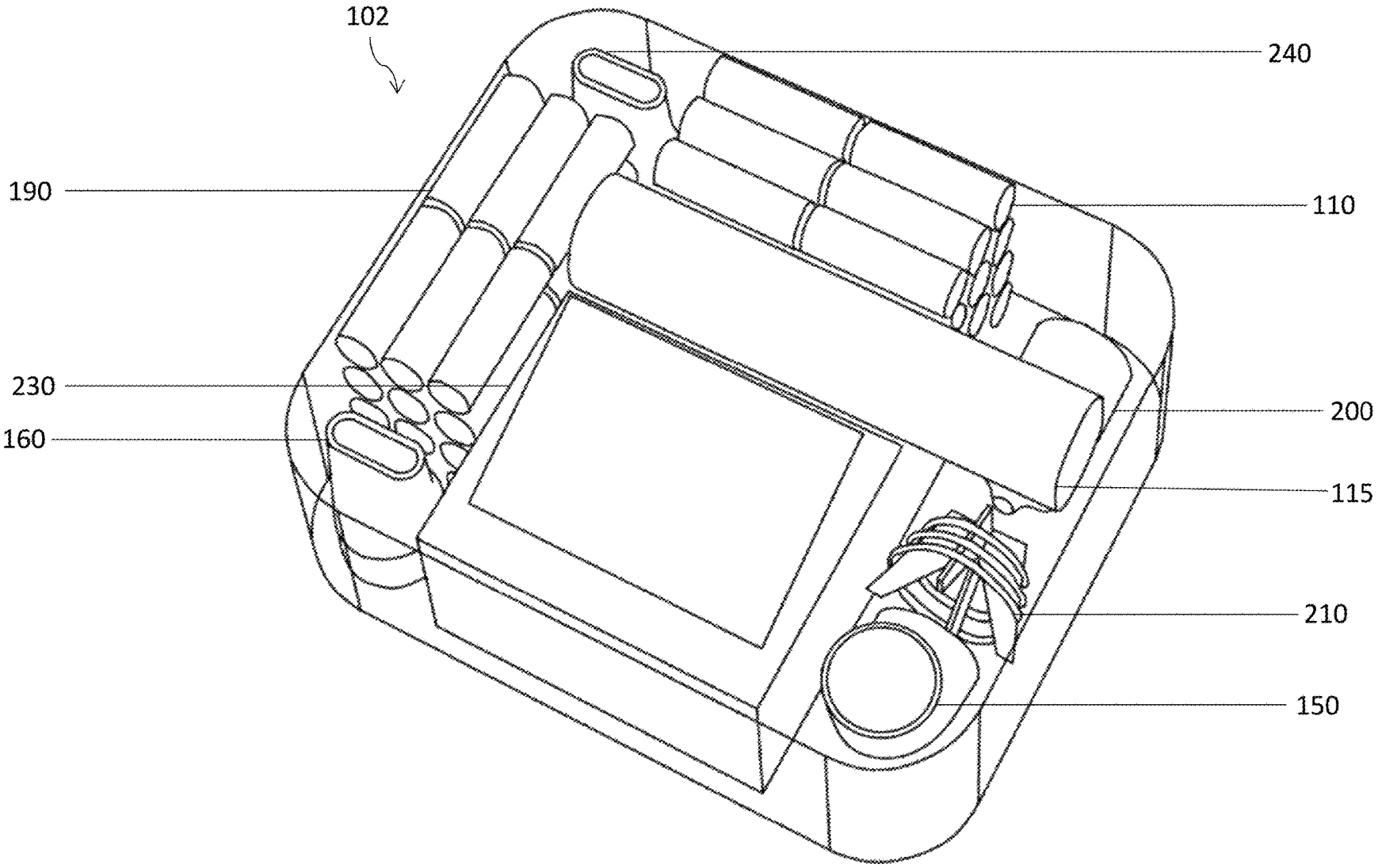
FIG. 6 illustrates a perspective orthogonal transparent view of a portable bed heating device according to one embodiment of the present invention.
Figure 7:
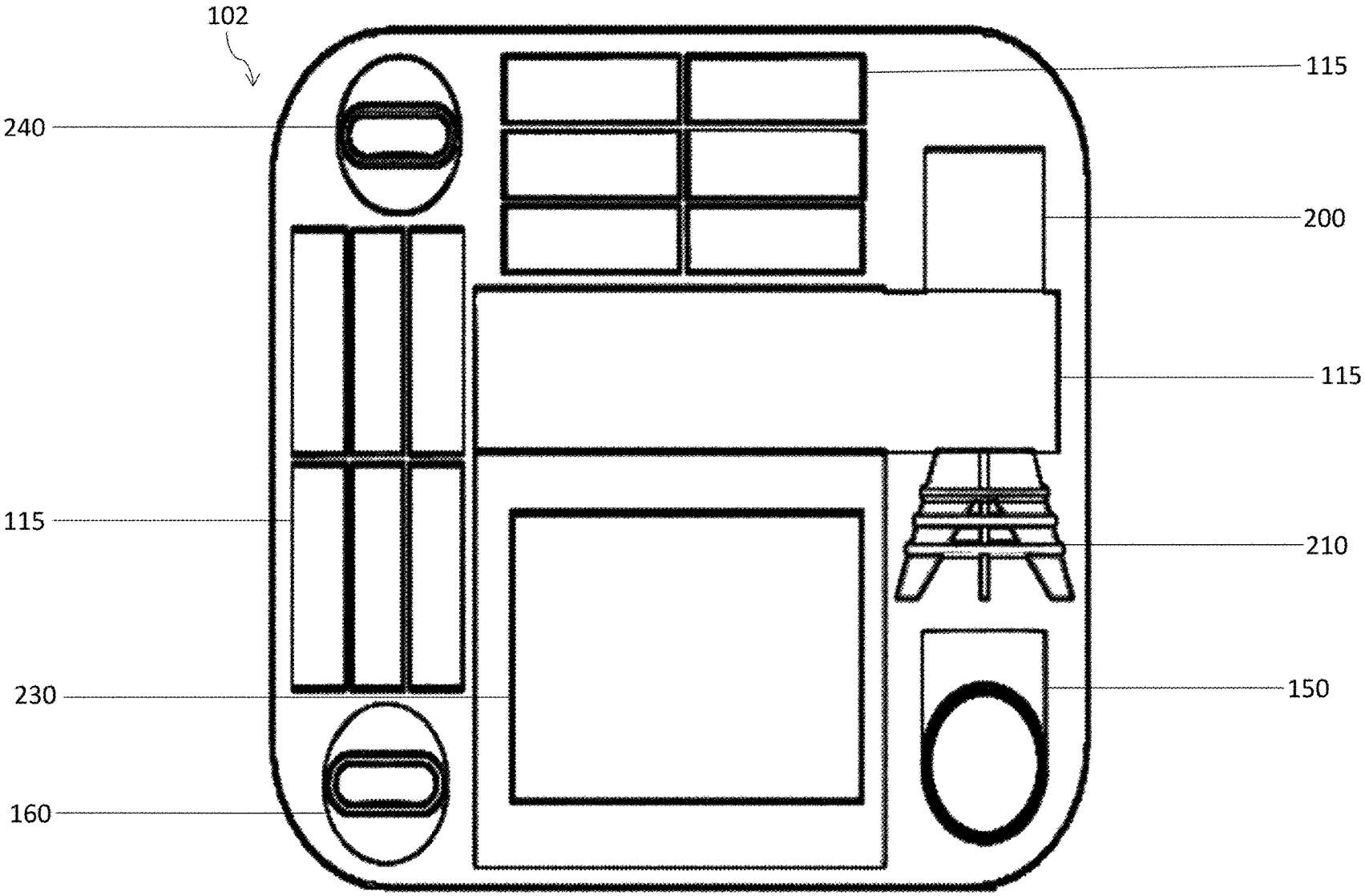
FIG. 7 illustrates a top orthogonal transparent view of a portable bed heating device according to one embodiment of the present invention.
Figure 8:
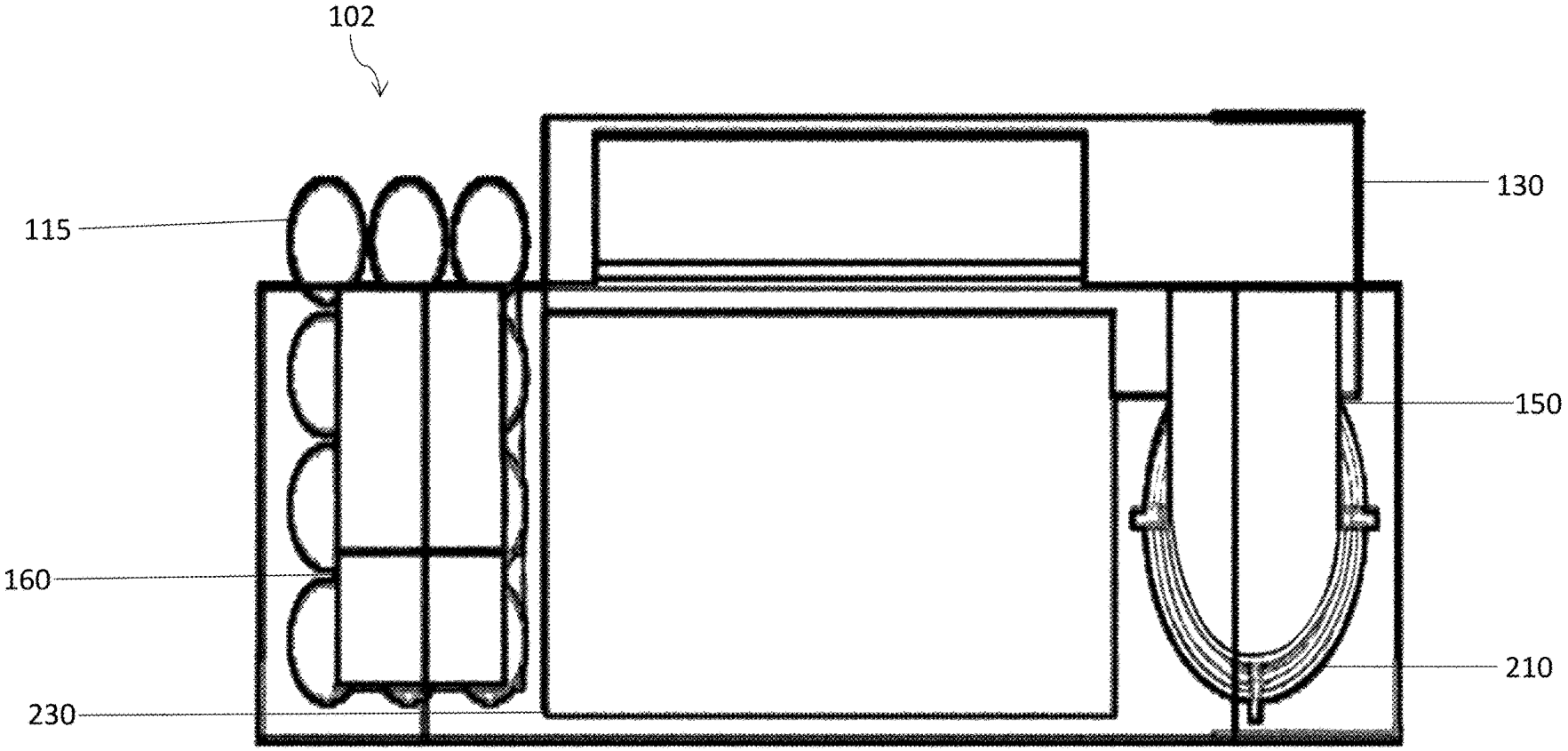
FIG. 8 illustrates a side orthogonal transparent view of a portable bed heating device according to one embodiment of the present invention.

FIGS. 6-8 illustrate transparent views of a heating module 102. In one embodiment, the heating module 102 includes a motor 200, an extendable air hose 130, a heating element 210, a hot air exhaust vent 150, a primary air nozzle 160, at least one secondary air nozzle 240, a control panel 320, at least one primary battery pack 110, at least one backup battery pack 190, and a battery charger adapter 230. In one embodiment, both the at least one primary battery pack 110 and the at least one secondary battery pack 190 are made of lithium-ion cells, but one of ordinary skill in the art will understand that the types of batteries able to be used with the present invention are not intended to be limiting. In one embodiment, the battery charger adapter 230 includes a charging port and is operable to receive power from a power cord connected to a traditional wall outlet. In one embodiment, the battery charger adapter 230 is operable to charge the at least one primary battery pack 110 while simultaneously providing power to the motor 200 and heating element 210. In another embodiment, the battery charger adapter 230 is operable to charge the at least one primary battery pack 110 while the at least one primary battery pack 110 is simultaneously discharging power to the motor 200 and heating element 210. In yet another embodiment, the battery charger adapter 230 is operable to charge both the at least one primary battery pack 110 and the at least one backup battery pack 190 while simultaneously providing power to the motor 200 and heating element 210. Advantageously, the battery charger adapter 230, the at least one primary battery pack 110, and the at least one backup battery pack enable the portable heating device 100 to operate as either a portable heating device powered by batteries or as a stationary heating device powered by a 120V wall outlet.

In one embodiment, the heating element 210 is an electric coil and uses resistive heating to warm up the cold air that is pulled into the portable heating device 100 through an air intake. In one embodiment the electric coil of the heating element 210 is electrically connected to the at least one primary battery pack 110, and draws a current from the primary battery pack. The internal resistance within the electric coil of the heating element 210 is operable to transform the energy received from the at least one battery pack 110 and transform it into heat. The portable heating device 100 is operable to receive a set temperature input from a remote controller. The set temperature is what determines the current drawn by the heating element 210. A higher set temperature will require the heating element to have a higher current draw which correlates to a higher power draw. If the heating device 100 is set to a lower set temperature, then the heating element will require a lower current draw which correlates to a lower power draw. The control panel 230 is operable to receive a user input from a remote controller to program the portable heating device 100 to desired settings. Such settings include, but are not limited to, temperature, duration, timer, fan intensity, and power mode. The temperature setting is the set temperature at which the heating element 210 will heat the cold air being pulled in by the air intake. The control panel 230 is operable to receive a user input for the desired set temperature at certain times. By way of example and not limitation, the control panel is operable to be programmed to exhaust warm air at a temperature of 72 degrees Fahrenheit from 9:00 PM to 11:00 PM then exhaust warm air at a temperature of 68 degrees from 11:00 PM to 7:00 AM and then proceed to automatically shut off. The control panel is also operable to receive a user input for the desired duration. By way of example and not limitation, the control panel is operable to be programmed to operate at a certain temperature for thirty minutes then proceed to shut off. The control panel 230 is also operable to receive a user input for a desired timer that controls the time the portable heating device 100 is operating. By way of example and not limitation the control panel 230 is operable to be preprogrammed to operate at a set temperature of 74 degrees Fahrenheit from 7:30 AM to 8:00 AM. The control panel 230 enables the portable heating device 100 to control the exhaust air temperature at specific times. Research has shown that there is a direct correlation between body temperatures and quality of sleep during certain times of the human sleep schedule. Advantageously, the portable heating device 100 is operable to exhaust warm to the air under a blanket or within a sleeping bag on a timely schedule that matches the sleep cycle of a user upon receiving a user input with the desired settings. The control panel 320 is also operable to receive a user input for a desired fan intensity. The fan intensity is the rate at which a fan within the air intake pulls in cold air and pushed out warm air. By way of example and not limitation, the control panel 230 is operable to be programmed to operate the fan of the air intake on a high speed for thirty minutes then proceed to decrease the fan to a low speed after fifteen minutes of operation. The speed at which the fan of the portable heating device operates dictates how long it takes to heat up a desired area to a desired temperature.

The control panel 230 is operable to receive a user input that dictates the power mode at which the portable heating device 100 operates. Such power modes include, but are not limited to economy mode, low battery, and normal mode. The economy mode is designed to achieve the desired ambient air temperature in the most efficient way possible. By way of example and not limitation, if the control panel 230 is programmed to 72 degrees Fahrenheit, then the portable heating device 100 will slowly warm up the air until a temperature sensor of the portable heating device reads that the ambient air temperature has reached 72 degrees Fahrenheit, at which point the portable heating device will enter a rest state. Once the temperature sensor of the portable heating devices reads that the ambient air temperature has dropped below 72 degrees Fahrenheit, the portable heating device 100 will transition out of the rest state and proceed to warm up the ambient air until the temperature sensor reads 72 degrees Fahrenheit again. Low battery mode optimizes battery longevity to achieve a desired temperature. Similar to economy mode, low battery mode requires that the portable heating device periodically transition between a rest state and an active state with the purpose of maintaining charge within the at least one primary battery pack 110 and the at least one backup battery pack 190 for as long as possible. The difference between low battery mode and economy mode is that in low battery mode the portable heating device 100 will not operate at high temperatures. When the portable heating device 100 is operating at higher temperatures the heating element 210 draws a higher current which results in a faster rate of discharge from the at least one primary battery pack 110. The low battery mode is designed for emergency and survival purposes. For example, in occasions where the user does not have access to a power supply and is in a dangerously low temperature environment, the low battery mode provides the longest battery life while still exhausting warm air to the user. In normal mode, the portable heating device 100 is always in an active state and does not transition between an active state and rest state unless the control panel 230 received an input to set a timer. In the case of the control panel 230 is programmed to follow a set timer, the portable heating device 100 will transition from an active state to a rest state as according to the programming of the timer.

In one embodiment, at least one external temperature sensor is attached to the at least one air exhaust vent of the heating module 102, at least one end of an extendable air hose, and/or to an air nozzle delivering air. The at least one external temperature sensor provides for a temperature feedback mechanism for adjusting current draw by the heating element within the heating module 102. For example, if the setpoint temperature is set to approximately 72 degrees Fahrenheit and the external temperature sensor detects a temperature of 65 degrees, then more current will be drawn to the heating element, causing it to increase in temperature to increase the temperature of the outgoing air. In one embodiment, the at least one primary battery provides variable power supply for allowing different levels of heating. The heat provided by the variable power supply scales linearly with the power consumed by the heating element. In one embodiment, the amount of power provided to the heating element is controlled by a microcontroller within the heating module 102. The at least one external temperature sensors are placed on the at least one air exhaust vent and/or the extendable air hose, as these components are proximate to the area where the air is delivered, allowing for more accurate temperature feedback.

In one embodiment, the heating module 102 includes at least one internal temperature sensor. The at least one internal temperature sensor is configured to automatically turn off the heating module 102 if a temperature is detected greater than a preset threshold temperature. This feedback mechanism is useful, as it allows the system to prevent from overheating, potentially damaging internal components and reducing risk of fires, burning the user, or other damage.

In one embodiment, the at least one internal temperature sensor and/or the at least one external temperature sensor communicate data to the heating module 102 via direct wired connection. In another embodiment, the at least one internal temperature sensor and/or the at least one external temperature sensor communicate data to the heating module 102 via at least one network (e.g., a wireless local area network (WLAN, e.g., WI-FI) or a wireless personal area network (WPAN, e.g., BLUETOOTH)). In yet another embodiment, the at least one internal temperature sensor and/or the at least one external temperature sensor communicate data to the heating module 102 via infrared, ultra-wide band (UWB), or near-field communication (NFC) signals.

Figure 9:
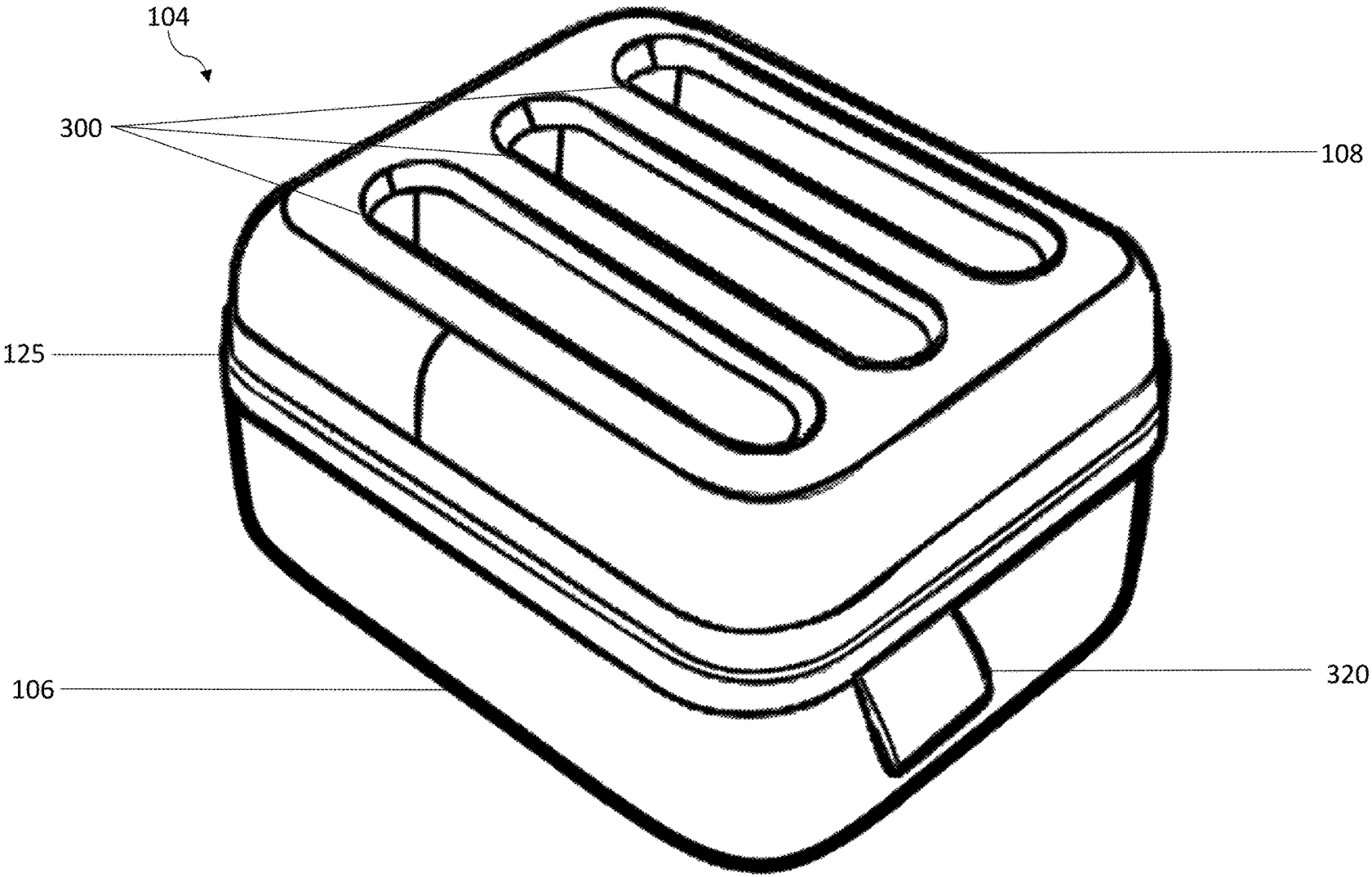
FIG. 9 illustrates a perspective view of a closed travel case according to one embodiment of the present invention.
Figure 10:
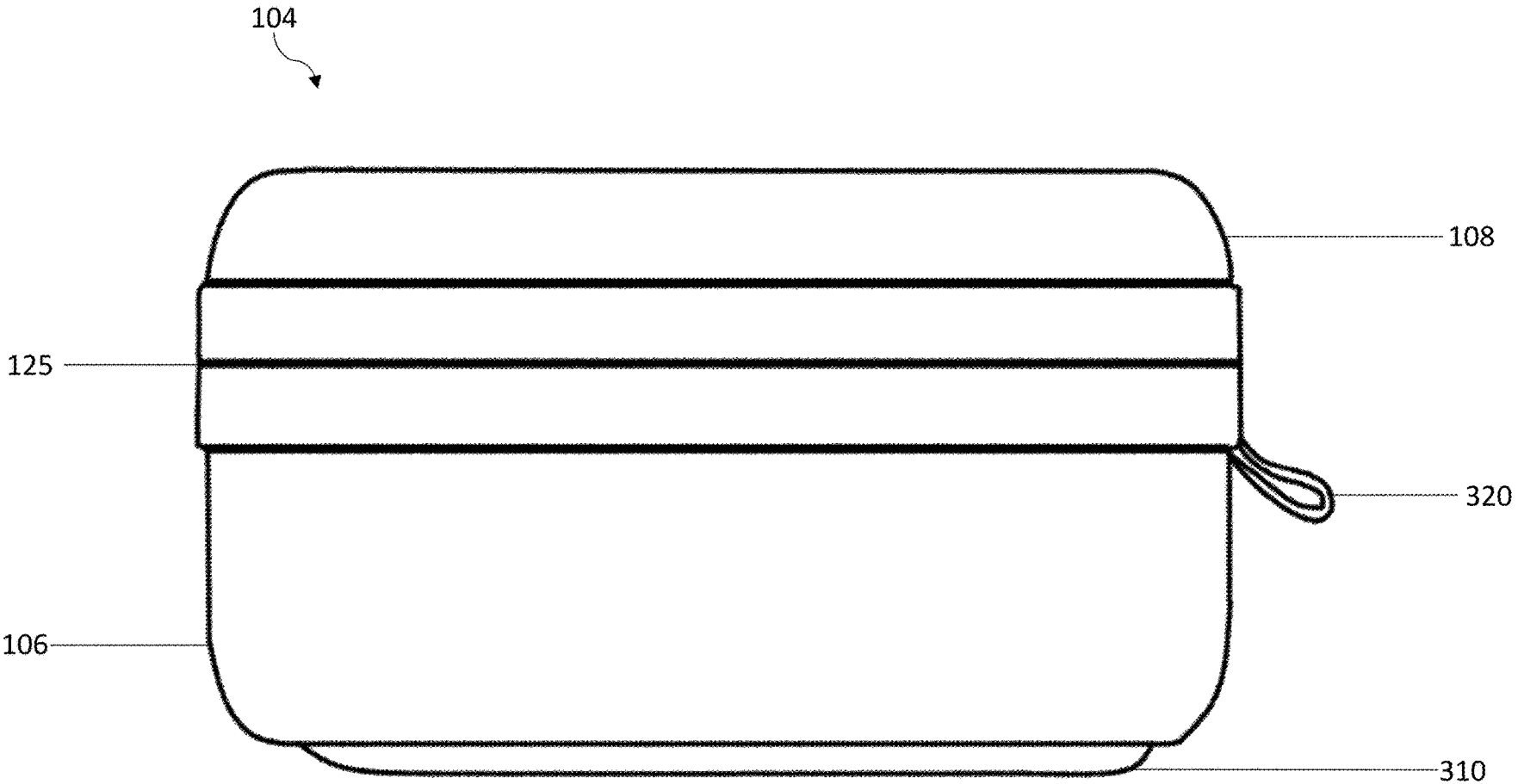
FIG. 10 illustrates a side orthogonal view of a closed travel case according to one embodiment of the present invention.

FIGS. 9 and 10 illustrate different perspectives of the travel case shell 104 according to one embodiment of the present invention. The travel case shell 104 includes at least three stamps 300, a travel case zipper 125, at least three legs 310, and a pull tab 320. In one embodiment, the outside of the travel case 105 is made of a durable material such as, but not limited to, aluminum, steel, carbon fiber-reinforced plastic, polypropylene, high-density polyethylene (HDPE), polycarbonate, any other fiber-reinforced composite material, and/or any other form of stiff, non-fiber-reinforced plastic. In one embodiment, the interior of the travel case is made from a shock absorbing material such as, but not limited to, a foam liner, a silicone resin, or polyurethane. The at least three stamps 300 and the at least three legs 310 allow for one travel case shell 104 to be stacked on top of another travel case shell 104 with extra stability. This is advantageous for quickly transporting multiple portable heating devices 100 to a disaster relief site without having to pack multiple portable heating devices 100 into corrugated boxes prior to transportation.

Figure 11:
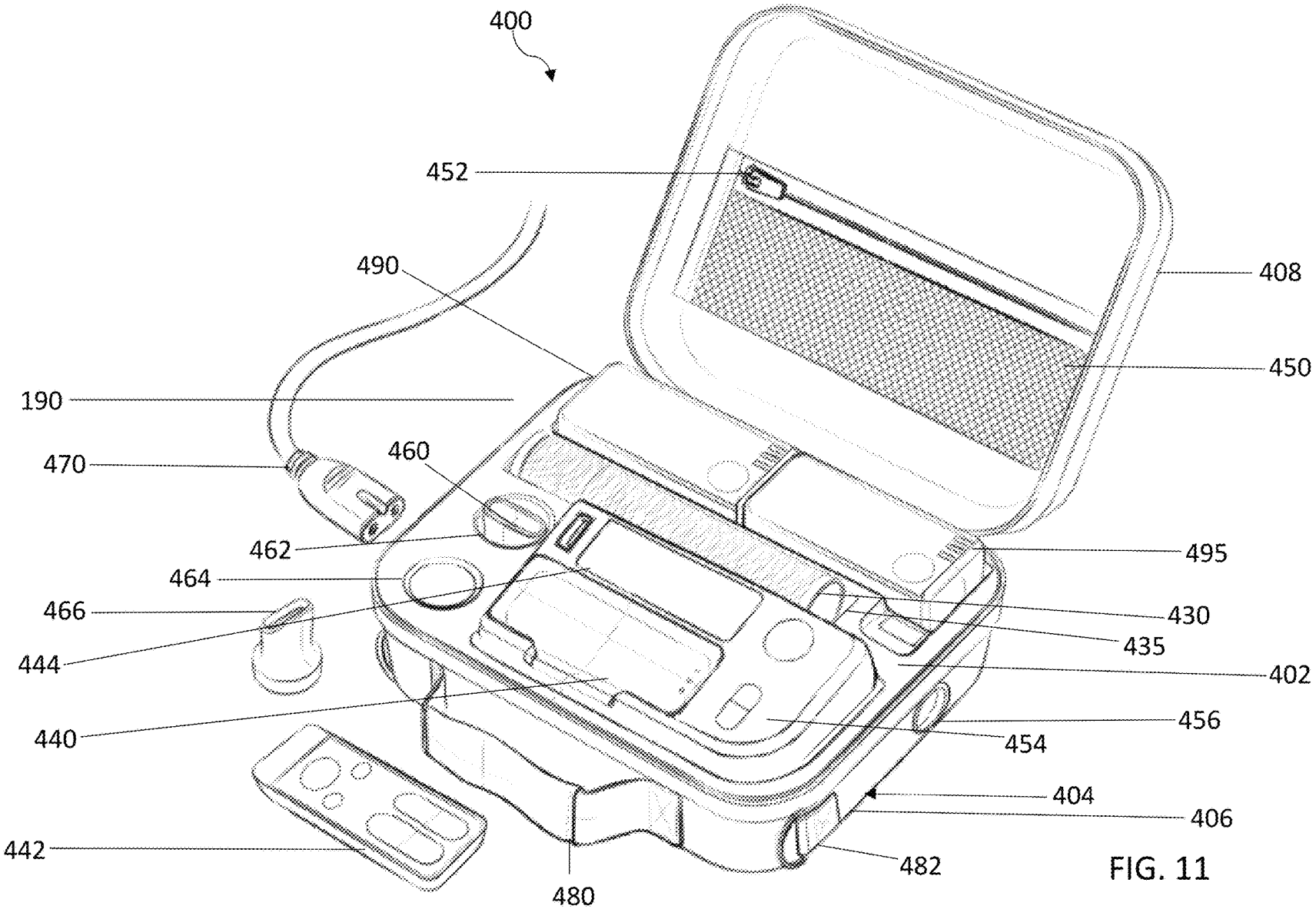
FIG. 11 illustrates a perspective view of an open portable bed heating device according to one embodiment of the present invention.

FIG. 11 illustrates a perspective view of an open portable bed heating device according to one embodiment of the present invention. A portable bed heating device 400 includes a heating module 402 nested within an exterior case 404. The exterior case includes a lower portion 406 and an upper lid 408 configured to encapsulate the heating module 402. In one embodiment, the lower portion 406 and the upper lid 408 are hingedly attached. In one embodiment, an interior surface of the upper lid 408 includes at least one a power cord pocket 450, configured to hold at least one power cable and/or other components. In one embodiment, the at least one power cord pocket 450 includes at least one closing mechanism 452 (e.g., a zipper) configured to open and close the at least one power cord pocket 450. In one embodiment, the at least one power cord pocket 450 is attached to the interior surface of the upper lid 408 via adhesive and/or via a sewed connection. In one embodiment, the lower component is attached (e.g., via adhesive, via sewed connection, etc.) to at least one handle 480, able to be used to transport the portable bed heating device 400. In one embodiment, the lower component is attached (e.g., via adhesive, via sewed connection, etc.) to at least one strap attachment ring 482. In one embodiment, the at least one strap attachment ring 482 is able to be attached to a strap for easy transport of the portable bed heating device 400.

In one embodiment, the heating module 402 includes one or more compartments for holding individual components of the portable bed heating device 400. In one embodiment, the one or more compartments are depressions in a top surface of the heating module 402. In one embodiment, the depressions are sized and shaped to correspond with specific components of the portable bed heating device 400 to assist in ease of packing. In another embodiment, the one or more compartments include fully enclosed chambers within the heating module 402. By way of example and not limitation, the one or more compartments include a first air nozzle compartment 462, a second air nozzle compartment 464, an air hose compartment 435, one or more battery compartments, and/or additional compartments. In one embodiment, the inclusion of a first air nozzle compartment 462 and a second air nozzle compartment 464 allows for the use and storage of multiple different types of nozzle 460, 466 (e.g., with different cross-sectional areas), which are useful for different applications (e.g., bed vs. sleeping bag). One of ordinary skill in the art will understand that the heating module 402 is not limited to including only two air nozzle compartments and is capable of including any number of air nozzle compartments. Similarly, one of ordinary skill in the art will understand that the number of air hose compartments and/or battery compartments are not intended to be limiting according to the present invention.

The air hose compartment 435 is configured to house at least one air hose 430. The at least one air hose 430 is configured to attach to at least one air exhaust vent of the heating module 402 for creating an extended air path for heated air produced by the heating module 402.

In one embodiment, the heating module 402 is powered by at least one primary battery unit 490. In one embodiment, the at least one primary battery unit 490 is easily detachable from the heating module 402, such as by application of moderate force, actuation of at least one latch, and/or any other detachment mechanisms. In one embodiment, the heating module 402 includes at least one backup battery unit 495. The at least one backup battery unit 495 does not actively power the heating module 402, but is instead kept for convenient storage purposes. In one embodiment, the heating module 402 is capable of being connected to at least one external power source (e.g., a power outlet) via at least one power cable 470, and the at least one external power source is operable to power and/or charge the at least one primary battery unit 490, allowing the unit to be used for longer periods. In another embodiment, connection of the at least one external power source also powers the at least one backup battery unit 495. In one embodiment, the at least one primary battery unit 490 and/or the at least one backup battery unit 495 are charged by at least one solar cell attached to an exterior surface of the case, providing more power availability for uses in remote areas (e.g., camping, military, etc.).

In one embodiment, the heating module 402 includes a control panel 454 for modifying a temperature of exhausted air exiting the heating module 402. In one embodiment, the exterior case 456 includes at least one opening 456 aligned with at least one air exhaust vent of the heating module 402, allowing hot air to be released from the heating module 402 through the exterior case 404 into the environment. In one embodiment, the control panel 454 includes a display 444 indicating a current setpoint temperature for the portable bed heating device 400, a time, and/or any other relevant data. In one embodiment, the control panel 454 includes a plurality of buttons used to modify the setpoint temperature of the device 400 and/or change any other relevant setting (e.g., change between display in Fahrenheit and Celsius). In one embodiment, the control panel 454 includes an on-off button or switch. In one embodiment, the control panel 454 includes a remote compartment 440 for holding at least one remote 442. The remote 442 is able to communicate with the control panel 454 to change settings of the portable bed heating device 400. In one embodiment, the remote 442 is able to send signals to the control panel 454 via at least one wireless personal area network (WPAN) (e.g., BLUETOOTH) and/or at least one wireless local area network (WLAN) (e.g., WI-FI). In another embodiment, the remote 442 is able to send infrared and/or near-field communication (NFC) signals to the control panel 454.

In one embodiment, the control panel 454 is operable to receive commands from at least one personal user device (e.g., a smart phone, a tablet, a computer, a smart watch, etc.). In one embodiment, the control panel 454 is operable to sync at least one personal user device to specifically receive commands from that personal user device.

Figure 12:
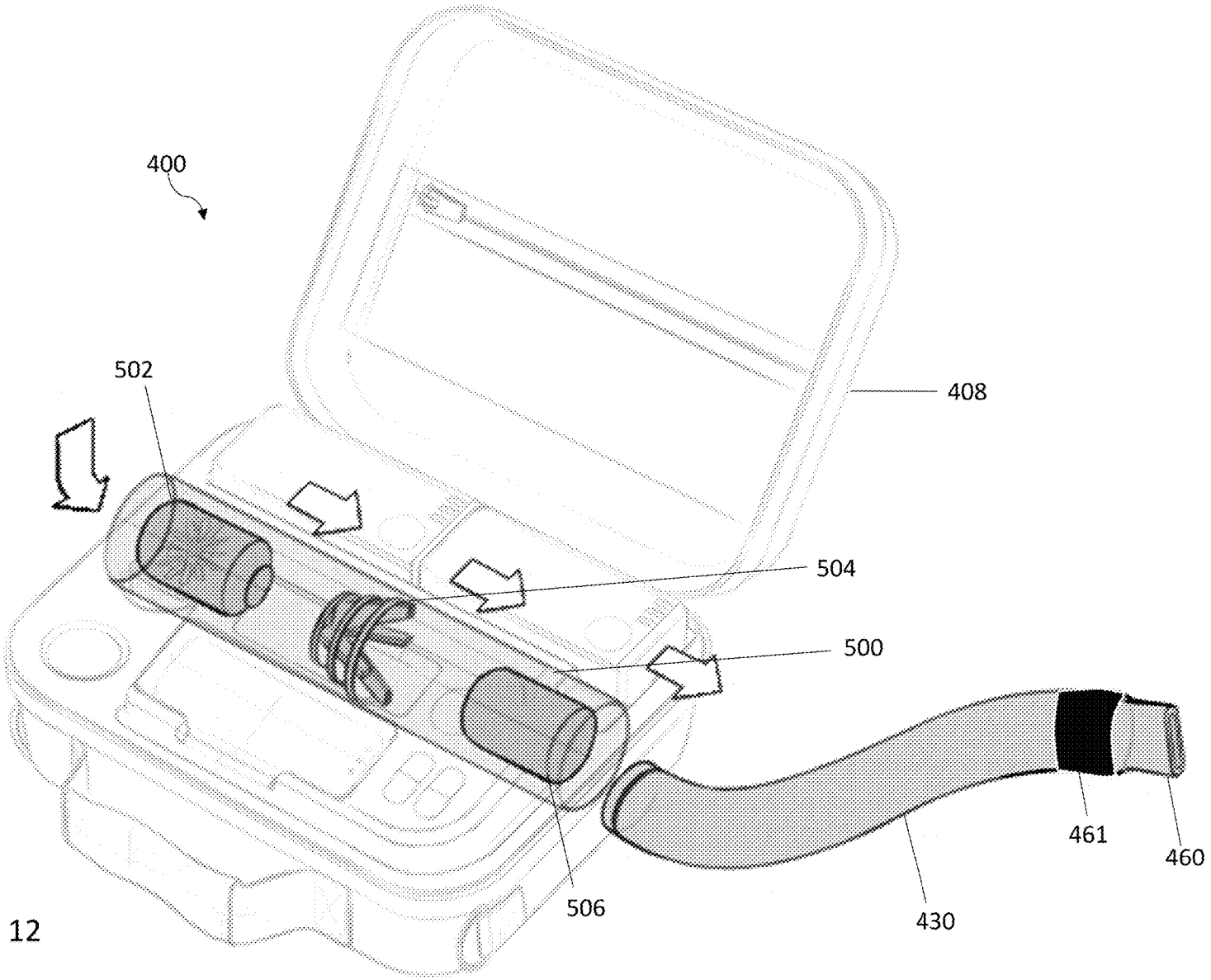
FIG. 12 illustrates a transparent perspective view of an open portable bed heating device according to one embodiment of the present invention.

FIG. 12 illustrates a transparent perspective view of an open portable bed heating device according to one embodiment of the present invention. In one embodiment, the exterior case 404 includes at least one intake opening aligned with at least one intake vent of the heating module 402. In one embodiment, the at least one intake opening extends through a side of the exterior case 404, such that the at least one intake vent is not blocked when the exterior case 404 is closed. In one embodiment, the heating module 402 includes at least one fan 502 proximate to the at least one intake vent, with the at least one fan 502 pulling exterior air into the heating module 402 such that it will able to be heated. In one embodiment, the at least one fan 502 is positioned within an internal channel 500 extending through the width of heating module 402 between the at least one intake vent and the at least one air exhaust vent. In one embodiment, between the at least one fan 502 and the at least one air exhaust vent is at least one heating element 504 configured to heat upon application of current from the at least one primary battery, allowing the air within the heating module 402 to be heated. In one embodiment, the internal channel 500 is substantially linear, as shown in FIG. 12. In one embodiment, the internal channel 500 is an insulated tube, preventing heat from easily escaping from the internal channel 500 that would otherwise potentially damage the heating module 402 and/or reduce efficiency of the heating element 504. In one embodiment, the internal channel 500 includes a secondary fan 506 configured to pull air heated by the heating element 504 out of the air exhaust vent. In one embodiment, the at least one fan 502 and/or the secondary fan 506 is a turbine directly connected to a motor within the heating module 402, which drives rotation of the turbine blades. The air exhaust vent is able to be connected to an extendable hose 430 for longer range delivery of the heated air from the heating module 402. In one embodiment, the extendable hose 430 is attached to an air nozzle 460 for focusing the delivered air. In one embodiment, a temperature sensor 461 is placed between the attachment of the extendable hose 430 and the air nozzle 460 for safety monitoring.

Figure 13:
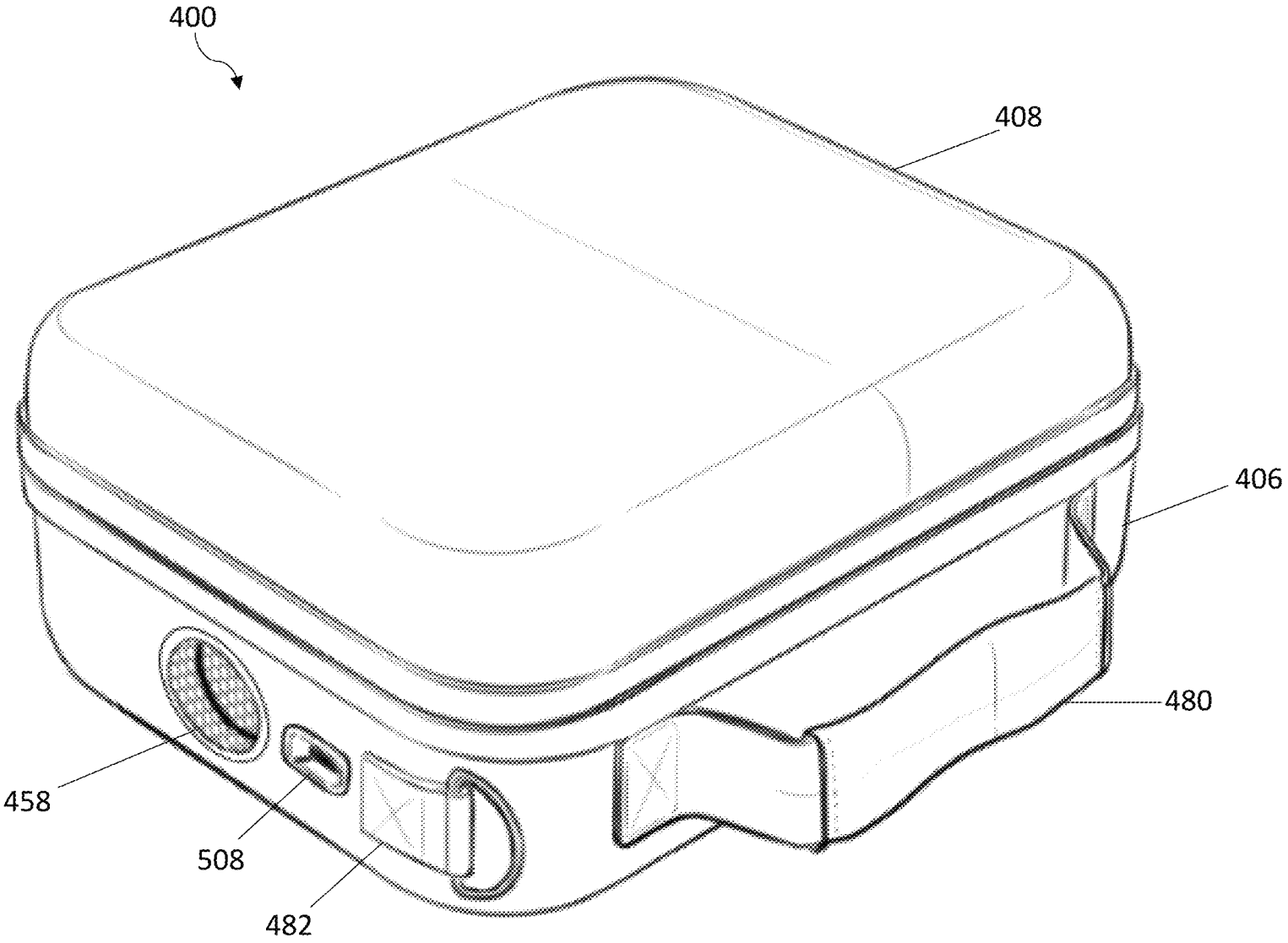
FIG. 13 illustrates a perspective view of a closed portable bed heating device according to one embodiment of the present invention.

FIG. 13 illustrates a perspective view of a closed portable bed heating device according to one embodiment of the present invention. In one embodiment, the exterior case 404 includes at least one power cord opening 408 configured to allow passage of at least one power cable for connecting to the heating module 402. In one embodiment, the exterior case includes at least one air intake opening 458 for allowing air to enter the at least one air intake vent of the heating module 402 while the case 404 is in a closed position. Advantageously, the embodiment shown in FIGS. 11-13 is able to heat and deliver air while the case 404 is in a closed position, as neither the air intake vent nor the air exhaust vent are blocked when the case 404 is closed.

Figure 14:
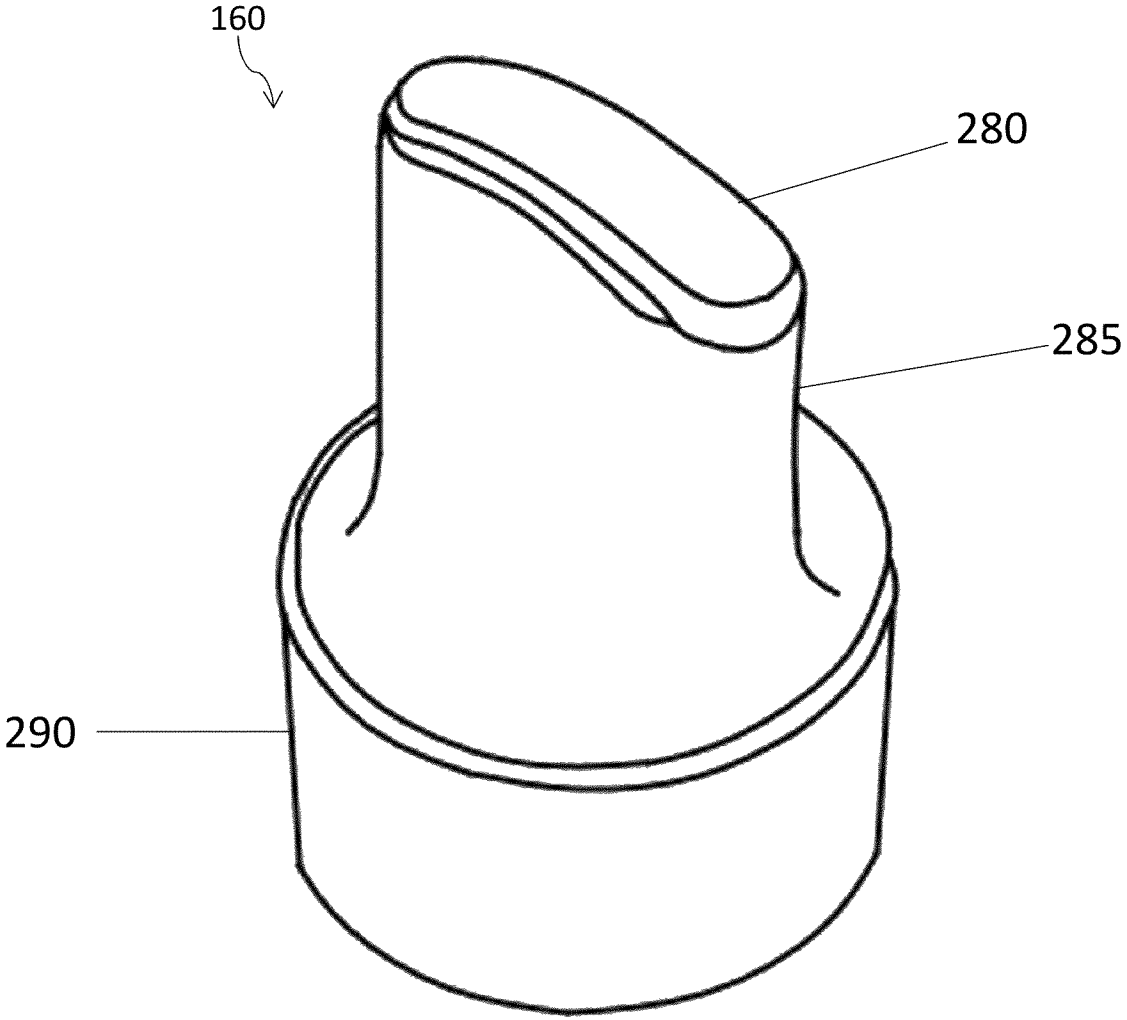
FIG. 14 illustrates a perspective view of an air nozzle according to one embodiment of the present invention.

FIG. 14 illustrates an air nozzle 160 according to one embodiment of the present invention. The air nozzle 160 includes an air nozzle opening 280, an air nozzle neck 285, and an air nozzle base 290. The air nozzle 160 connects to an air hose of the present invention to direct warm air to a specific area. In one embodiment, the interior of the air nozzle base 290 is threaded such that is operable to mate with external threading on one end of the air hose to screw the air nozzle 160 onto the air hose. The neck of the air nozzle 280 tapers off from the air nozzle base 290 to the air nozzle opening 285. This taper decreases the cross-sectional area of the air nozzle 160 toward the delivery end of the air nozzle 280 and causes the flow rate of warm air to increase as it exits the air nozzle 160 and flows in the ambient air. In one embodiment, the cross section of the air nozzle opening 285 is a circle. In another embodiment, the cross section of the air nozzle opening 285 is an ellipse. However, otherwise shaped cross-sectional areas are also contemplated herein. Different cross-sectional areas and shapes of the air nozzle opening 285 will have different effects. For example, a smaller circular cross-sectional area will result in the higher warm air flow rate than a larger elliptical cross-sectional area. In one embodiment, the air nozzle neck 280 is flexible such that the air nozzle neck 280 is operable to be manipulated to direct air flow in various directions.

One of ordinary skill in the art will understand that although the present invention is useful in warming the extremities of a user, it is not limited to only heating extremities and is capable of heating a whole human body. Furthermore, the present invention is not limited to being used only in sleeping environments, such as a bed or sleeping bag, but is also able to be used in spaces such as vehicles (e.g., cars, boats, etc.) or in larger living spaces, such as a living room.

Figure 15:
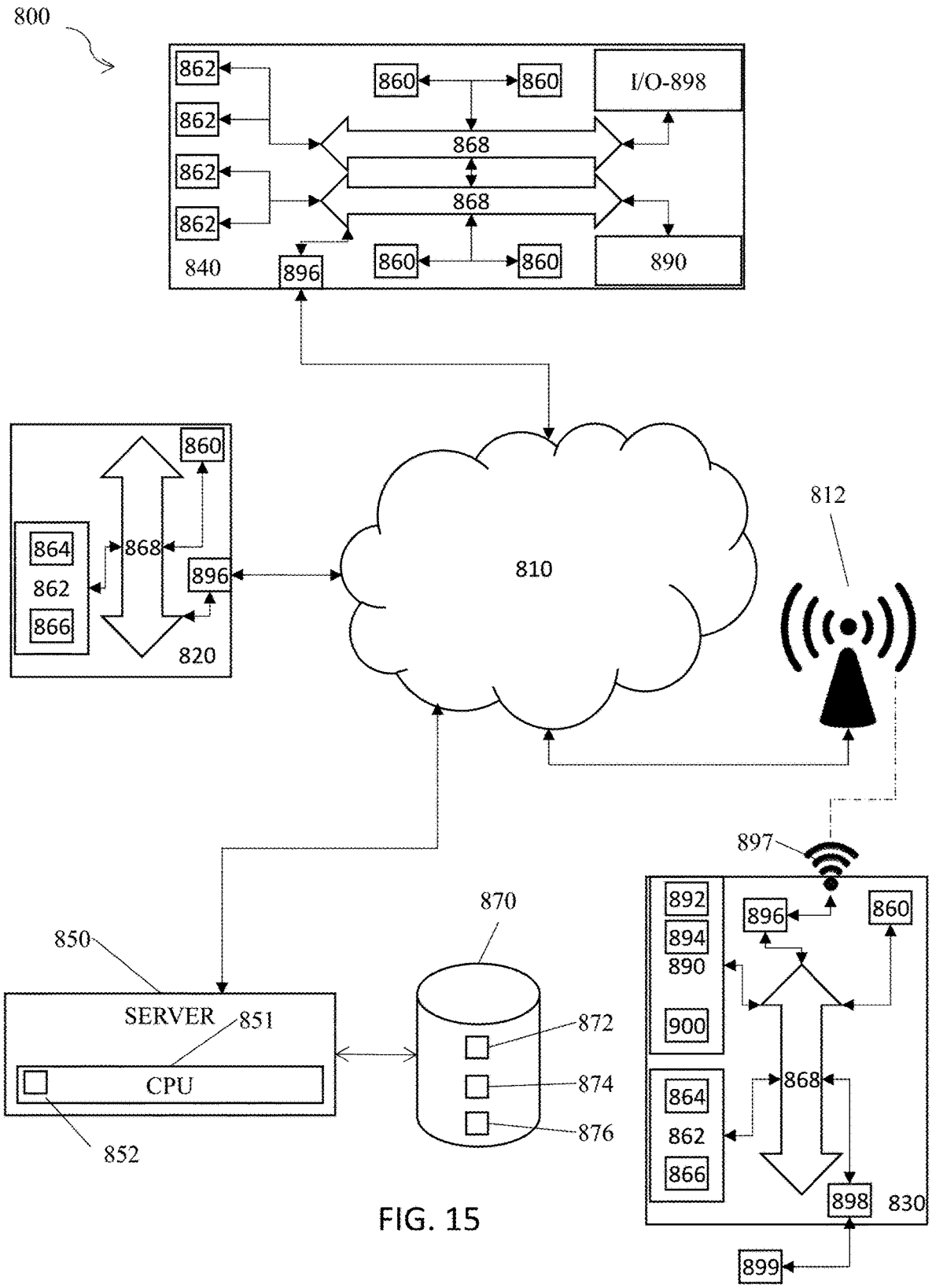
FIG. 15 is a schematic diagram of a system of the present invention.

FIG. 15 is a schematic diagram of an embodiment of the invention illustrating a computer system, generally described as 800, having a network 810, a plurality of computing devices 820, 830, 840, a server 850, and a database 870.

The server 850 is constructed, configured, and coupled to enable communication over a network 810 with a plurality of computing devices 820, 830, 840. The server 850 includes a processing unit 851 with an operating system 852. The operating system 852 enables the server 850 to communicate through network 810 with the remote, distributed user devices. Database 870 is operable to house an operating system 872, memory 874, and programs 876.

In one embodiment of the invention, the system 800 includes a network 810 for distributed communication via a wireless communication antenna 812 and processing by at least one mobile communication computing device 830. Alternatively, wireless and wired communication and connectivity between devices and components described herein include wireless network communication such as WI-FI, WORLDWIDE INTEROPERABILITY FOR MICROWAVE ACCESS (WIMAX), Radio Frequency (RF) communication including RF identification (RFID), NEAR FIELD COMMUNICATION (NFC), BLUETOOTH including BLUETOOTH LOW ENERGY (BLE), ZIGBEE, Infrared (IR) communication, cellular communication, satellite communication, Universal Serial Bus (USB), Ethernet communications, communication via fiber-optic cables, coaxial cables, twisted pair cables, and/or any other type of wireless or wired communication. In another embodiment of the invention, the system 800 is a virtualized computing system capable of executing any or all aspects of software and/or application components presented herein on the computing devices 820, 830, 840. In certain aspects, the computer system 800 is operable to be implemented using hardware or a combination of software and hardware, either in a dedicated computing device, or integrated into another entity, or distributed across multiple entities or computing devices.

By way of example, and not limitation, the computing devices 820, 830, 840 are intended to represent various forms of electronic devices including at least a processor and a memory, such as a server, blade server, mainframe, mobile phone, personal digital assistant (PDA), smartphone, desktop computer, netbook computer, tablet computer, workstation, laptop, and other similar computing devices. The components shown here, their connections and relationships, and their functions, are meant to be exemplary only, and are not meant to limit implementations of the invention described and/or claimed in the present application.

In one embodiment, the computing device 820 includes components such as a processor 860, a system memory 862 having a random access memory (RAM) 864 and a read-only memory (ROM) 866, and a system bus 868 that couples the memory 862 to the processor 860. In another embodiment, the computing device 830 is operable to additionally include components such as a storage device 890 for storing the operating system 892 and one or more application programs 894, a network interface unit 896, and/or an input/output controller 898. Each of the components is operable to be coupled to each other through at least one bus 868. The input/output controller 898 is operable to receive and process input from, or provide output to, a number of other devices 899, including, but not limited to, alphanumeric input devices, mice, electronic styluses, display units, touch screens, gaming controllers, joy sticks, touch pads, signal generation devices (e.g., speakers), augmented reality/virtual reality (AR/VR) devices (e.g., AR/VR headsets), or printers.

By way of example, and not limitation, the processor 860 is operable to be a general-purpose microprocessor (e.g., a central processing unit (CPU)), a graphics processing unit (GPU), a microcontroller, a Digital Signal Processor (DSP), an Application Specific Integrated Circuit (ASIC), a Field Programmable Gate Array (FPGA), a Programmable Logic Device (PLD), a controller, a state machine, gated or transistor logic, discrete hardware components, or any other suitable entity or combinations thereof that can perform calculations, process instructions for execution, and/or other manipulations of information.

In another implementation, shown as 840 in FIG. 15, multiple processors 860 and/or multiple buses 868 are operable to be used, as appropriate, along with multiple memories 862 of multiple types (e.g., a combination of a DSP and a microprocessor, a plurality of microprocessors, one or more microprocessors in conjunction with a DSP core).

Also, multiple computing devices are operable to be connected, with each device providing portions of the necessary operations (e.g., a server bank, a group of blade servers, or a multi-processor system). Alternatively, some steps or methods are operable to be performed by circuitry that is specific to a given function.

According to various embodiments, the computer system 800 is operable to operate in a networked environment using logical connections to local and/or remote computing devices 820, 830, 840 through a network 810. A computing device 830 is operable to connect to a network 810 through a network interface unit 896 connected to a bus 868. Computing devices are operable to communicate communication media through wired networks, direct-wired connections or wirelessly, such as acoustic, RF, or infrared, through an antenna 897 in communication with the network antenna 812 and the network interface unit 896, which are operable to include digital signal processing circuitry when necessary. The network interface unit 896 is operable to provide for communications under various modes or protocols.

In one or more exemplary aspects, the instructions are operable to be implemented in hardware, software, firmware, or any combinations thereof. A computer readable medium is operable to provide volatile or non-volatile storage for one or more sets of instructions, such as operating systems, data structures, program modules, applications, or other data embodying any one or more of the methodologies or functions described herein. The computer readable medium is operable to include the memory 862, the processor 860, and/or the storage media 890 and is operable be a single medium or multiple media (e.g., a centralized or distributed computer system) that store the one or more sets of instructions 900. Non-transitory computer readable media includes all computer readable media, with the sole exception being a transitory, propagating signal per se. The instructions 900 are further operable to be transmitted or received over the network 810 via the network interface unit 896 as communication media, which is operable to include a modulated data signal such as a carrier wave or other transport mechanism and includes any delivery media. The term "modulated data signal" means a signal that has one or more of its characteristics changed or set in a manner as to encode information in the signal.

Storage devices 890 and memory 862 include, but are not limited to, volatile and non-volatile media such as cache, RAM, ROM, EPROM, EEPROM, FLASH memory, or other solid state memory technology; discs (e.g., digital versatile discs (DVD), HD-DVD, BLU-RAY, compact disc (CD), or CD-ROM) or other optical storage; magnetic cassettes, magnetic tape, magnetic disk storage, floppy disks, or other magnetic storage devices; or any other medium that can be used to store the computer readable instructions and which can be accessed by the computer system 800.

In one embodiment, the computer system 800 is within a cloud-based network. In one embodiment, the server 850 is a designated physical server for distributed computing devices 820, 830, and 840. In one embodiment, the server 850 is a cloud-based server platform. In one embodiment, the cloud-based server platform hosts serverless functions for distributed computing devices 820, 830, and 840.

In another embodiment, the computer system 800 is within an edge computing network. The server 850 is an edge server, and the database 870 is an edge database. The edge server 850 and the edge database 870 are part of an edge computing platform. In one embodiment, the edge server 850 and the edge database 870 are designated to distributed computing devices 820, 830, and 840. In one embodiment, the edge server 850 and the edge database 870 are not designated for distributed computing devices 820, 830, and 840. The distributed computing devices 820, 830, and 840 connect to an edge server in the edge computing network based on proximity, availability, latency, bandwidth, and/or other factors.

It is also contemplated that the computer system 800 is operable to not include all of the components shown in FIG. 15, is operable to include other components that are not explicitly shown in FIG. 15, or is operable to utilize an architecture completely different than that shown in FIG. 15. The various illustrative logical blocks, modules, elements, circuits, and algorithms described in connection with the embodiments disclosed herein are operable to be implemented as electronic hardware, computer software, or combinations of both. To clearly illustrate this interchangeability of hardware and software, various illustrative components, blocks, modules, circuits, and steps have been described above generally in terms of their functionality. Whether such functionality is implemented as hardware or software depends upon the particular application and design constraints imposed on the overall system. Skilled artisans may implement the described functionality in varying ways for each particular application (e.g., arranged in a different order or partitioned in a different way), but such implementation decisions should not be interpreted as causing a departure from the scope of the present invention.

Certain modifications and improvements will occur to those skilled in the art upon a reading of the foregoing description. The above-mentioned examples are provided to serve the purpose of clarifying the aspects of the invention and it will be apparent to one skilled in the art that they do not serve to limit the scope of the invention. All modifications and improvements have been deleted herein for the sake of conciseness and readability but are properly within the scope of the present invention.

The invention claimed is:

1. A portable heating device, comprising:

an exterior case;

a heating module nested within the exterior case;

at least one battery unit connected to and powering the heating module; and at least one remote device; and wherein the exterior case includes an upper component and a lower component connected via a hinge, wherein the upper component and the lower component are configured to close;

wherein the heating module is nested within the lower component of the exterior case;

wherein the heating module includes at least one air intake, configured to take in air from the surrounding environment;

wherein the heating module includes at least one air exhaust vent positioned along the interior side of the lower component, such that the at least one air exhaust vent is aligned with the at least one air intake at opposite ends of a linear internal channel, and wherein the at least one air exhaust vent is configured to attach to at least one retractable hose;

wherein the heating module includes a first depression sized and shaped to receive the at least one retractable hose and a second depression sized and shaped to receive the attachable air nozzle;

wherein the first depression is positioned parallel to the at least one battery unit;

wherein the heating module includes at least one heating element configured to heat air entering through the at least one air intake and exiting through the at least one air exhaust vent; and wherein the heating module is operable to receive at least one transmission from the remote device, wherein the transmission includes a temperature setting of the heating module.

2. The portable heating device of claim 1, further comprising a console, wherein the console includes a remote device compartment configured to receive the at least one remote device.

3. The portable heating device of claim 1, wherein the exterior case includes at least one air intake port aligned with the at least one air intake of the heating module.

4. The portable heating device of claim 1, wherein the exterior case includes at least one air exhaust port aligned with the at least one air exhaust vent of the heating module.

5. The portable heating device of claim 1, wherein the heating module is operable to generate heated air through the at least one air exhaust vent while the exterior case is in a closed position.

6. The portable heating device of claim 1, wherein the retractable hose is matingly connected to an attachable air nozzle.

7. The portable heating device of claim 1, wherein the first depression is configured to hold and fully contain the at least one retractable hose while the exterior case is in a closed position.

8. The portable heating device of claim 1, wherein the lower component of the exterior case includes a charging port opening, wherein the charging port opening of the lower component aligns with a charging port of the heating module when the heating module is nested within the exterior case.

9. A portable heating device, comprising:

a heating module connected to and powered by at least one battery unit;

at least one remote device; and a console including an electronic display;

wherein the heating module includes at least one air intake, configured to take in air from the surrounding environment;

wherein the heating module includes at least one air exhaust vent positioned along the interior side of the lower component, such that the at least one air exhaust vent is aligned with the at least one air intake at opposite ends of a linear internal channel, and wherein the at least one air exhaust vent is configured to attach to at least one retractable hose;

wherein the heating module includes at least one heating element configured to heat air entering through the at least one air intake and exiting through the at least one air exhaust vent;

wherein the console protrudes outwardly from the heating module;

wherein the electronic display is positioned in the center of the heating module and protrudes from the heating module;

wherein the electronic display is configured to display a temperature of the heating module;

wherein the heating module is configured to receive signals from at least one remote device, and wherein the heating module is operable to adjust a temperature of outgoing air through the at least one air exhaust vent based on the signals from the at least one remote device;

wherein the heating module is operable to receive at least one transmission from the remote device, wherein the transmission includes a temperature setting of the heating module;

wherein the heating module receives sensor data from at least one temperature sensor attached to the at least one retractable hose; and wherein the heating module is configured to automatically adjust the temperature of the outgoing air based on the sensor data.

10. The portable heating device of claim 9, wherein the retractable hose is matingly connected to an attachable air nozzle.

11. The portable heating device of claim 9, wherein the console further includes a universal serial bus (USB) port.

12. The portable heating device of claim 9, wherein the heating module is nested within an exterior case.

13. The portable heating device of claim 12, wherein the exterior case includes at least one power opening aligned with at least one power port of the heating module, and wherein the at least one power port of the heating module is configured to receive at least one connection to an external power source for operating the heating module and/or charging the at least one battery unit.

14. The portable heating device of claim 12, wherein the exterior case includes at least one air intake port aligned with the at least one air intake of the heating module.

15. The portable heating device of claim 12, wherein the exterior case includes at least one air exhaust port aligned with the at least one air exhaust vent of the heating module.

16. The portable heating device of claim 12, wherein the heating module is operable to generate heated air through the at least one air exhaust vent while the exterior case is in a closed position.

17. A portable heating device, comprising:

an exterior case;

a heating module nested within the exterior case; and at least one battery unit connected to and powering the heating module;

at least one remote device; and a console including an electronic display;

wherein the exterior case includes an upper component and a lower component connected via a hinge;

wherein the heating module is nested within the lower component of the exterior case;

wherein the heating module includes at least one air exhaust vent positioned along the interior side of the lower component, such that the at least one air exhaust vent is aligned with the at least one air intake at opposite ends of a linear internal channel, and wherein the at least one air exhaust vent is configured to attach to at least one retractable hose;

wherein the at least one retractable hose is configured to matingly connect to an attachable air nozzle;

wherein the heating module includes at least one heating element configured to heat air exiting through the at least one air exhaust vent;

wherein the heating module is operable to receive at least one transmission from the remote device, wherein the transmission includes a temperature setting of the heating module; and wherein the heating module is operable to generate heated air through the at least one air exhaust vent while the upper and lower component of the exterior case are matingly closed.

18. The portable heating device of claim 17, wherein the at least one retractable hose attaches to the at least one air exhaust vent via a mating threaded connection and/or frictional engagement.

19. The portable heating device of claim 17, wherein the exterior case includes at least one air exhaust port aligned with the at least one air exhaust vent of the heating module.

20. The portable heating device of claim 17, wherein the at least one retractable hose is configured to matingly connect to an attachable air nozzle.

* * * * *